US008469473B2

(12) United States Patent
Arakawa et al.

(10) Patent No.: US 8,469,473 B2
(45) Date of Patent: Jun. 25, 2013

(54) INKJET RECORDING APPARATUS

(75) Inventors: Hiroaki Arakawa, Uenohara (JP); Takahiro Matsuzawa, Hino (JP)

(73) Assignee: Konica Minolta Holdings, Inc., Tokyo (JP)

( * ) Notice: Subject to any disclaimer, the term of this patent is extended or adjusted under 35 U.S.C. 154(b) by 14 days.

(21) Appl. No.: 13/201,884

(22) PCT Filed: Feb. 12, 2010

(86) PCT No.: PCT/JP2010/052044

§ 371 (c)(1), (2), (4) Date: Aug. 17, 2011

(87) PCT Pub. No.: WO2010/095565

PCT Pub. Date: Aug. 26, 2010

(65) Prior Publication Data

US 2011/0298852 A1 Dec. 8, 2011

(30) Foreign Application Priority Data

Feb. 20, 2009 (JP) ..... 2009-037742

(51) Int. Cl.
*B41J 29/38* (2006.01)

(52) U.S. Cl.
USPC ..... 347/9; 347/5; 347/12

(58) Field of Classification Search
USPC ..... 347/5, 9, 12, 19, 14
See application file for complete search history.

(56) References Cited

U.S. PATENT DOCUMENTS

2006/0012631 A1 1/2006 Niekawa

FOREIGN PATENT DOCUMENTS

| | | | |
|---|---|---|---|
| JP | 5-338210 | A | 12/1993 |
| JP | 2006-51794 | A | 2/2006 |
| JP | 2007-234718 | A | 9/2007 |
| JP | 2008-230200 | A | 10/2008 |

OTHER PUBLICATIONS

International Search Report dated Mar. 9, 2010 issued in International Appln. No. PCT/JP2010/052044.

*Primary Examiner* — Lam S Nguyen
(74) *Attorney, Agent, or Firm* — Holtz, Holtz, Goodman & Chick, P.C.

(57) ABSTRACT

An inkjet recording apparatus includes a recording head having three rows of nozzles which are three-phase driven and arranged in a staggered arrangement. The nozzles are arranged in the main scanning direction at an interval of L/3, where L is a pixel pitch, and each nozzle row is ejection-driven in the sequence from the last nozzle row to the forward nozzle row in the moving direction of the recording head. The recording head scans at a moving speed of 2×L×f, where f is an ejection frequency per nozzle row. After the completion of one scan, the recording medium is moved a distance of predetermined multiples of the pixel pitch in the sub-scanning direction, and in the next scan, ink is ejected onto the recording medium at pixel positions other than the pixel position on which the ink has landed in preceding scans.

4 Claims, 28 Drawing Sheets

INKJET RECORDING APPARATUS

This application is a U.S. National Phase Application under 35 USC 371 of International Application PCT/JP2010/052044 filed Feb. 12, 2010.

TECHNICAL FIELD

The present invention relates to an inkjet recording apparatus, and in particular, to an inkjet recording apparatus using a recording head having nozzles in a staggered arrangement which are driven by multiple-phase.

BACKGROUND

As an image forming apparatus capable of recording an image on a substrate (hereinafter called a recording medium) having a low ink absorbability such as resin film besides ordinary substrates such as a paper and a texture, there has been developed an inkjet recording apparatus which lands ink ejected from a nozzle disposed at an end surface (a so-called nozzle surface) of a recording head on the substrate, and at the present day, a technology of the apparatus is applied to various technical fields.

In so doing, as the recording head used in the inkjet recording apparatus, a recording head in which nozzles are arranged in rows in parallel on the nozzle surface is often used However, in recent years, as FIG. 24 shows, there has been often used a recording head having three nozzles rows 3*m*, 3*m*+1 and 3*m*+2 in which a plurality of nozzles N are arranged in a staggered form with a predetermined interval in a main scanning direction X indicated by an arrow X in the figure (for example, refer to Patent Document 1). Incidentally, in FIG. 24, under the recording head H, namely on a back side in the figure, there is a recording medium S, and nozzles are formed on a nozzle surface P, wherein the nozzle surface P represents a side, which is facing the recording medium S, of the recording head.

As above, the arrangement of the nozzles N in which nozzle positions of the adjacent nozzles N are displaced in the main scanning direction X is called a staggered arrangement. The staggered arrangement is often configured by repeating an arrangement to displace the nozzle positions for every three or four nozzles N. In case the nozzle positions are displaced every three nozzles N, generally, each nozzle N3*m* denoted by N3*m* (m=0, 1, 2 . . . ) is arranged in an row in a sub-scanning direction perpendicular to the main scanning direction, and the nozzles N3*m*+1, and N3*m*+2 denoted by N3*m*+1 and Nm+2 are arranged in an row in the sub-scanning direction Y respectively.

Supposing that a pixel pitch on the recording medium S is L, a nozzle interval p between each of rows of nozzles N3*m*, N3*m*+1 and N3*m*+2 is configured to be ⅓ or ⅔ of the pixel pitch L, namely L/3 or 2L/3. Also, an interval q between each adjacent nozzle N in the sub-scanning direction Y is usually configured to be equal to the pixel pitch L.

Incidentally, each nozzle N3*m* belongs to the same row is collectively called nozzle row 3*m*. Namely, a nozzle row configured with each nozzle N3*m* denoted by the nozzle number 3*m* (m=0, 1, 2, . . . ) is called a nozzle row 3*m*, and the a nozzle row configured with each nozzle N3*m*+1 denoted by the nozzle number 3*m*+1 is called a nozzle row 3*m*+1 and the a nozzle row configured with each nozzle N3*m*+2 denoted by the nozzle number 3*m*+2 is called a nozzle row 3*m*+2.

The nozzles N in the staggered arrangement are usually driven by a multi-phase and in the recording head H in which the nozzles N are disposed in the staggered arrangement by three nozzles as FIG. 24 shows, each of nozzles N3*m*, N3*m*+1 and N3*m*+2 is driven by three-phase. The three-phase drive of each of nozzles N3*m*, N3*m*+1, N m+2 having been conducted conventionally is conducted as follow.

Namely, as FIG. 25 shows, first, to change the phase of ejection drive, a strobe pulse STB1 is applied to each of the nozzles N3*m* in the nozzle row 3*m*, and in this state by applying an unillustrated drive pulse, ink is ejected to the recording medium S from each of the nozzles N3*m* in the nozzle row 3*m* to which the strobe pulse STB1 is applied.

Then, at the time when the recording head H is moved by ⅓ of the pixel pitch L in the main scanning direction X, the strobe pulse is changed from STB1 to STB2 and applied to each of nozzles N3*m*+1 in the nozzle row 3*m*+1. In this state, by applying the drive pulse, the ink is ejected to the recording medium S from each of the nozzles N3*m*+1 in the nozzle row 3*m*+1 to which the strobe pulse STB2 is applied. When this occurs, since the nozzle N3*m*+1 is behind the nozzle N3*m* by L/3 in the moving direction of the recording head H in the main scanning direction X, the ink ejected from each of nozzles N3*m*+1 lands on an adjacent position to the ink ejected from each of nozzles N3*m* in the sub-scanning direction Y on the recording medium S.

In the same manner, at the time when the recording head H is further moved by ⅓ of the pixel pitch L in the main scanning direction X, the strobe pulse is changed from STB2 to STB3 and applied to each of nozzles N3*m*+2 in the nozzle row 3*m*+2. In this state, by applying the drive pulse, ink is ejected to the recording medium S from each of the nozzles N3*m*+2 in the nozzle row 3*m*+2. On the recording medium S, the ink ejected from each of nozzles N3*m*+2 lands on an adjacent position in the sub-scanning direction Y on which the ink ejected from each of nozzles N3*m*+1 has been landed.

As above, by changing the strobe pulse from STB1, STB2 to STB3 sequentially so as to change driving phases, the ink ejected from each of nozzles N3*m* to N3*m*+2 can be landed on a line which extends in the sub-scanning direction on the recording medium S. Meanwhile, as above, a method to change the phases to drive from the nozzle N3*m* in a front section to the nozzle N3*m*+1 on a rear side sequentially in the moving direction of the recording head H in the main scanning direction X is called normal phase.

Also, by further moving the recording head H by ⅓ of the pixel pitch L in the main scanning direction, each of the nozzles N3*m* in the nozzle row 3*m* comes to a position which is distant the pixel pitch L from the position where the ink is first ejected. At that time, by applying the drive pulse in a state where the strobe pulse is changed from STB3 to STB1 and is applied to each of the nozzles N3*m* in the nozzle row 3*m*, the ink is ejected from each of the nozzles N3*m* in the nozzle row 3*m* to a position displaced by the pixel pitch L in the main scanning direction X from a position where the ink has been first ejected. Therefore, the ink lands on an adjacent position to the position when the ink has been first ejected from each nozzle N3*m* in the nozzle row 3*m*.

As above, every time the recording head is moved by L/3 in the main scanning direction X, by changing the strobe pulse from STB1 to STB2 and to STB3 sequentially, the ink is landed on the line extending in the sub-scanning direction, and the ink is also landed on another line in an adjacent position to the above line of the ink extending in the main scanning direction X on the recording medium S. In a conventional inkjet recording apparatus, by repeating operation to land the ink in the lines extending in the sub-scanning direction Y on the recording medium S, the ink lands on each pixel on the recording medium S so that an image is recorded on the recording medium S.

Meanwhile, as FIGS. 24 and 25 show, in case the recording head H moves to a left side in the figure, by changing the strobe pulse from STB1 to STB2 and to STB3 sequentially, the nozzle N to eject ink is changed from the nozzle N3*m* in the front section in the moving direction of the recording head H to the nozzle N3*m*+1 and to the nozzle N3*m*+2 on the rear side, however in case the image is recorded while the recording head H is being moved to the left side in the figure, the nozzle N in the front section in the moving direction of the recording head H is changed to the nozzle N3*m*+2, thus the strobe pulse is changed from STB3 to STB2 and to STB1 sequentially so that the nozzle N to eject ink is changed from the nozzle N3*m*+2 in the front side in the moving direction of the recording head H to the nozzle N3*m*+1 and to N3*m* on the rear side.

However, as above, when the image is recorded on the recording medium S, for example, if the ink is not ejected from the nozzle N normally because a specific nozzle is defective, as denoted by x, a portion to which ink is not ejected in a line shape extending in the main scanning direction X is formed in a corresponding position, thus a streak-like pattern appears in the image recorded on the recording medium S which deteriorates image quality. Incidentally, as FIG. 25 shows, if the nozzles N disable to eject ink are described in the figure, the figure becomes complicated, thus only positions where the ink is landed are denoted by circles in the figures below including FIG. 26.

In order to solve the above problem, in an inkjet recording apparatus in Patent Document 2, for example, as FIGS. 24 and 25 show, a so-called reverse phase is suggested that is when the recording head H is moved to a right side in the figure, instead of changing the nozzles N to eject ink from the nozzle N3*m* in the front section in moving direction of the recording head H in the main scanning direction to the nozzle N3*m*+1 and to N3*m*+2 on the rear side, the driving phase is changed so that the nozzle N is changed from the nozzle N3*m*+2 on the rear side in the moving direction of the recording head H in the main scanning direction X to the nozzle N3*m*+1 and to N3*m* in the front section.

In doing so, as FIG. 27 shows, by increasing the moving speed of the recording head H in the main scanning direction X two times, the same nozzle N ejects ink at every other pixel. As FIG. 28 shows, by disposing another recording head H' having nozzles M in the staggered arrangement in parallel to the recording head H in the main scanning direction X, or as FIG. 29 shows, by further disposing nozzles M in the staggered arrangement in parallel to the nozzles N in the main scanning direction X on the recording head H having the nozzles N in the staggered arrangement, and by driving the nozzles N as well as the nozzles M with an reverse phase for ejection, as FIG. 30 shows, the ink is ejected from the nozzles M and landed on gap sections to which the ink has been ejected from the nozzle N on the recording medium S so as to form the image on the recording medium S.

According to the above configuration, for example, even if some nozzles N fail and ink is not ejected from the nozzles N normally, the ink ejected from the normal nozzle M lands and fills a pixel position adjacent to the position on which the ink has not been ejected is supposed to land. Therefore, as FIG. 26 shows, it is prohibited that the portions when the ink is not ejected line up continuously in the main scanning direction X in the recorded image on the recording medium S, and a phenomenon that the streak-like pattern appears in the image can be prevented. Thus deterioration of image quality can be suppressed.

Meanwhile, in FIG. 27 (and in each figure below), the pulse width (time interval of high level of the pulse) of the strobe pulses STB1 to STB3 are described as if the pulse width is two times the pulse with of the strobe pulses STB1 to STB3 shown in FIG. 25. This is because the moving speed of the recording head D was increased two times and the pulse widths of the strobe pulses STB1 to STB3 themselves remain unchanged.

PRIOR ART DOCUMENT

Patent Document

Patent Document: Unexamined Japanese Patent Application Publication No. 2004-142100

Patent Document Unexamined Japanese Patent Application Publication No. 2008-230200

SUMMARY OF THE INVENTION

Problems to be Solved by the Invention

Incidentally, in the Patent document 2, the inkjet recording apparatus employs a line head method, and it operates on the premise that the image is recorded by ejecting ink onto all the pixels on the recording medium while the recording medium moves one time relatively to the recording head. Namely, the image will have to be recorded through a so-called one pass.

Thus, by driving each nozzle of the recording head to eject via the reverse phase and by increasing the moving speed of the recording head with respect to the recording medium two times, the ink is ejected from the nozzle N and lands onto every other pixel. In order to fill the gap section thereof, as FIG. 28 shows, it is necessary that another recording head having nozzles M in the staggered arrangement is further disposed in parallel to the recording head H in the main scanning direction X, or that the nozzles M in the staggered arrangement are disposed in parallel to the nozzles N in the main scanning direction X on the recording head H having the nozzles N in the staggered arrangement.

However, in case the recording head H having the nozzles N in the staggered arrangement and the recording head having the nozzles M in the staggered arrangement are provided separately, a cost increases so as to newly provide the recording head. Also, there are problems in that positional adjustment of the nozzles N and M of the recording heads becomes complicated and ejection timings of nozzles N and M have to be adjusted. Further, in case nozzles N and M in the staggered arrangement are provided in the recording head H, there is a problem that such an exclusive recording head has to be newly manufactured.

The above problems are caused by a restriction that the image is recorded through one pass since the inkjet recording apparatus employs a line head method, and in case of the serial head method inkjet recording apparatus the above problems do not occur. Namely, in case of the inkjet recording apparatus of the serial head method, it can be configured such that the image is recorded by ejecting ink onto all the pixels on the recording medium through a plurality of passes, namely while the recording head and the recording medium relatively move several times. Therefore, it is not necessary to dispose the new recording head or to manufacture the exclusive recording head, and the existing recording head can be utilized.

Thus, in the serial head method inkjet recording apparatus using the existing recording head where the nozzles N in the staggered arrangement are provided, it is desired that even if ejection failures due to nozzle failures in some of the nozzles N occur, as FIG. 26 shows, the image is prohibited to be seen as if the streak-like pattern exists in the image, thereby improving image quality of the recorded image.

The present invention has one aspect to solve the above problem and an object of the present invention is to provide an inkjet recording apparatus capable of improving the image quality of the recorded image without creating the streak-like pattern in the image in the serial head method inkjet recording apparatus using the recording head in which the nozzles are disposed in the staggered arrangement.

Means to Solve the Problem

To solve the above problem an inkjet recording apparatus according to one aspect of the present invention has a recording head, driven by each drive phase of a three-phase current, having nozzle rows of three nozzle rows in which a plurality of nozzles are disposed in a staggered arrangement with an interval of L/3 in the main scanning direction where L denotes a pixel pitch, and a control device to drive each nozzle row of the recording head in a sequence from one of the three nozzle rows located at an end to one of the three nozzle rows located in front in a relative moving direction of the recording head with respect to a recording medium, and to move the recording head at a moving speed of 2×L×f in a main scanning direction, wherein f represents an ejection frequency for each nozzle row of the recording head, and is characterized in that when the one scan by the recording head in the main scanning direction is completed, the control device moves the recording medium with respect to the recording head in a sub-scanning direction which is perpendicular to the main scanning direction by a distance of a predetermined multiple of the pixel pitch, and in a subsequent scan in the main scanning direction, the control device controls the recording head so that ink is ejected from each nozzle to a pixel position other than a pixel position where the ink has landed in the preceding scan by the recording head on the recording medium so as to record an image on the recording medium by landing the ink on each pixel on the recording medium.

According to another aspect of the present invention, the recording head is provided with two sets of the nozzle rows of three nozzle rows which are disposed in parallel in the main scanning direction, an interval between adjacent nozzles in the sub-scanning direction in a same nozzle row is set to be two times the pixel pitch and the nozzles in one set of the nozzle rows are displaced by one pixel pitch in the sub-scanning direction with respect to the nozzles in another set of the nozzle rows.

According to another aspect of the present invention, the recording head is provided with two sets of the nozzle rows of three nozzle rows which are disposed in parallel in the main scanning direction, an interval between adjacent nozzles in the sub-scanning direction in a same nozzle row is set to be four times the pixel pitch, and the nozzles in one set of the nozzle rows are displaced by two pixel pitches in the sub-scanning direction with respect to the nozzles in another set of the nozzle rows.

According to another aspect of the present invention, in an ink ejection operation from each nozzle for each ejection cycle which is conducted within one scan by the recording head in the main scanning direction the control section provides an ejection cycle where the ink is ejected from each nozzle and another ejection cycle when the ink is not ejected from each nozzle.

Effect of the Invention

According to the present invention, even if some nozzles are disabled and thus unable to eject ink normally due to a nozzle failure, since the ink ejected from the other normal nozzle lands and fills the pixel position which is adjacent to the pixel position on which the ink is supposed to land from the above disabled nozzle, the portions when ink is not ejected are prevented from lining up continuously in the main scanning direction in the recorded image on the recording medium, and the phenomenon that the streak-like pattern appears in the image is prevented. Therefore, the deterioration of image quality can be suppressed and the image quality can be improved.

Also, since the aforesaid effect can be realized using the existing head, it is not necessary to dispose another recording head in parallel as the inkjet recording apparatus cited in Patent document 2, or to use the exclusive recording head, and thus increase of manufacturing cost of the inkjet recording apparatus is suppressed and cost reduction is possible.

Further, in the conventional recording method, though the image can be recorded on the recording medium through one scan (so-called one pass) by the head, in the recording method of the present invention, two scans (so-called two passes) by the recording head is necessary to record the image on the recording medium. However, in the present invention, since the moving speed of the recording head in the main scanning direction is two times that of the conventional method, there is not much change in the time required for image recording compared to the conventional recording method. Namely, according to the present invention, the phenomenon that the streak-like pattern appears in the image can be prevented within almost the same recording time as that of the conventional recording method, in which conventional recording method the appearance of the streak-like pattern cannot be prevented.

In addition, the same effect can be also realized in case that there is used the recording head having two nozzle row sets configured with three rows disposed in parallel in the main scanning direction, wherein an interval between the adjacent nozzles in the sub-scanning direction in the same nozzle row set is set two times the pixel pitch, and the nozzles in the nozzle rows of one nozzle row set are offset by the pitch of one pixel with respect to the nozzles in the nozzles rows of other nozzle row set in the sub-scanning direction.

Still further, the same effect can be also realized, in case that there is used the recording head having two nozzle row sets configured with three rows disposed in parallel in the main scanning direction, wherein a distance between the adjacent nozzles in the sub-scanning direction in the same nozzle row set is set four times the pixel pitch, and the nozzles in one nozzle row set are offset by two pixel pitches with respect to the nozzles in another nozzle row set in the sub-scanning direction.

Yet still further, in addition to aforesaid effect, even in case some nozzles are disabled and thus unable to eject normally due to nozzle failure, since ink ejected from the plurality of other normal nozzles lands and fills the plurality of the pixel positions in between the pixel positions to which ink is not ejected from the disabled nozzles N, the pixel positions to which ink is not ejected are distributed sparsely, and thus the streak-like pattern in the recorded image on the recording medium can be more appropriately prevented.

DESCRIPTION OF THE PREFERRED EMBODIMENTS

Embodiments of inkjet recording apparatuses related to the present invention will be described with reference to the drawings as follow.

First Embodiment

Figure 1:
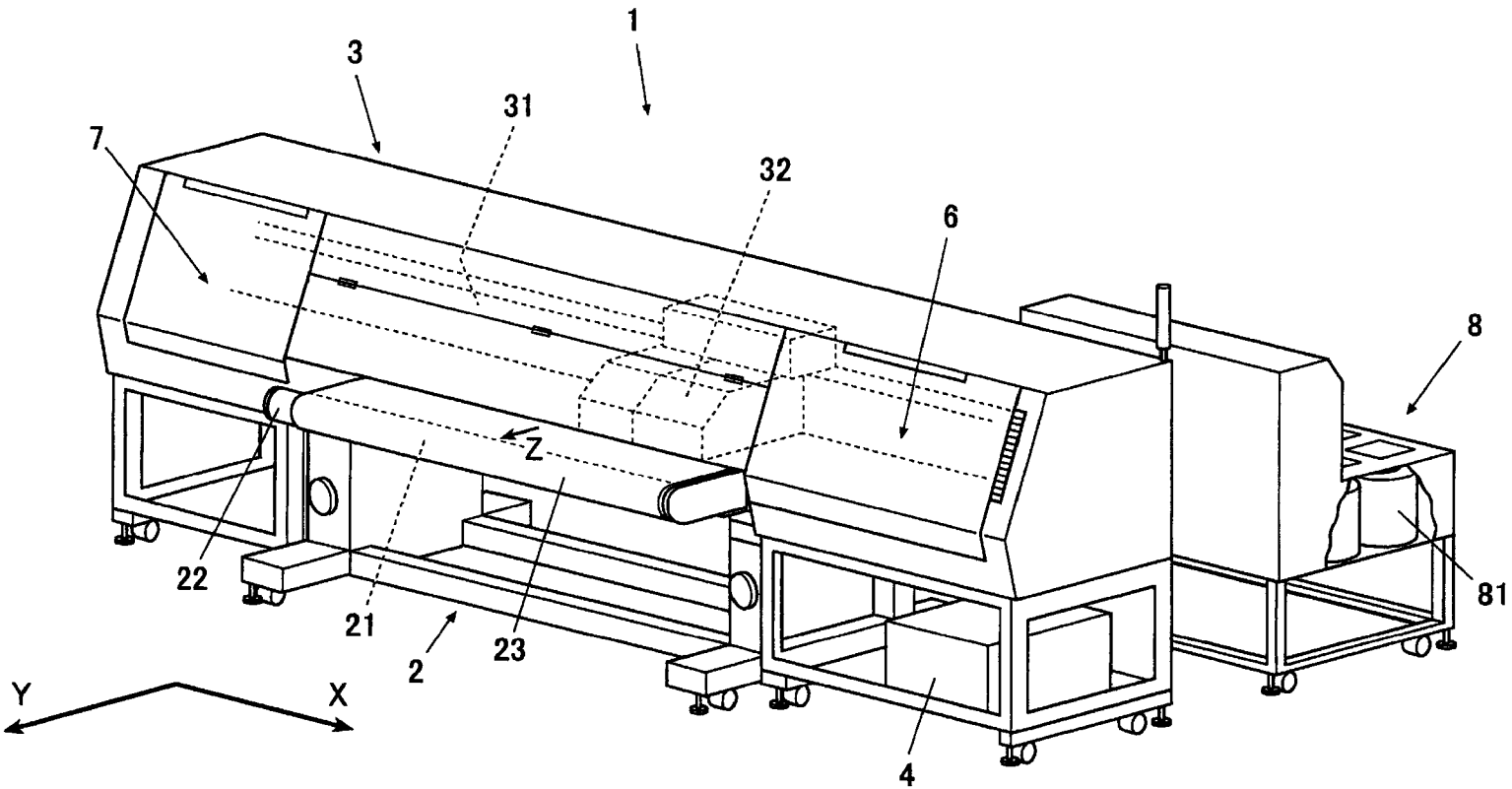
FIG. 1 is a schematic perspective view showing an entire configuration of an inkjet recording apparatus.
Figure 2:
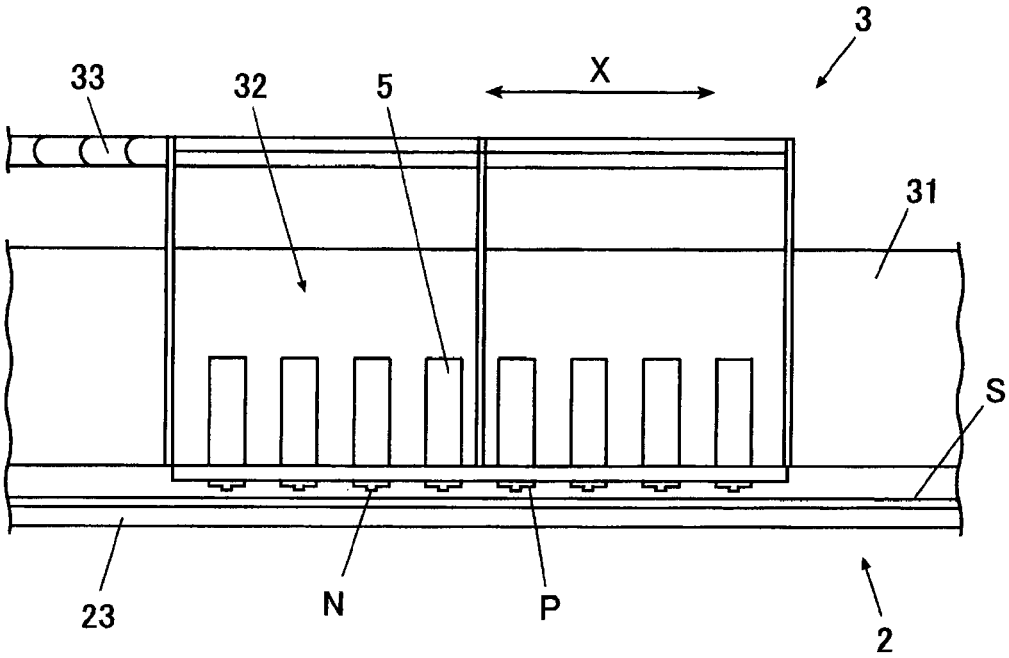
FIG. 2 is a magnified view of a carriage section including a recording head.

An inkjet recording apparatus 1 related to a first embodiment is mainly configured with a conveyance section 2, a main scanning section 3, and a computer 4 as FIG. 1 shows. Also, FIG. 2 is a magnified view of a carriage section in an internal structure of the main scanning section 3 including a recording head 5 to be described.

At an upper section of the conveyance section 2, a drive roller 21 extending in the main scanning direction X and an unillustrated driven roller are supported rotatably, and at one end side of the drive roller 21 a drive motor 22 to drive and rotate the drive roller 21 is disposed. A conveyance belt 23 in an endless shape is suspended between the drive roller 21 and the driven roller and the conveyance belt 23 conveys a recording medium S placed on the upper surface thereof in a conveyance direction Z by circling around the drive roller 21 and the driven roller when the drive roller 21 is rotated. When the drive roller 21 stops rotation, the conveyance belt 23 stops circling between both the rollers to stop conveyance of the recording medium S.

Then in accordance with control of the control device 9 to be described, when the one scan in the main scanning direction by the recording head is completed, the drive motor 22 rotates the drive roller 21 by a predetermined amount to convey the recording medium S in the conveyance direction Z by a predetermined distance and stops, then scanning in an opposite direction in the main scanning direction by the recording head 5 starts and finishes, the drive motor 22 rotates the drive roller 21 by the predetermined amount again to convey the recording medium S in the conveyance direction Z by the predetermined distance and stops. The above operation is repeated so that the recording medium S is conveyed via so-called intermittent conveyance.

Incidentally, the conveyance direction Z of the recording medium S is set to be parallel to the sub-scanning direction Y which is perpendicular to the main scanning direction X. Also, for example, the recording medium S can be conveyed on a platen in a shape of a flat plate in the conveyance direction Z (sub-scanning direction) instead of conveying the recording medium S on the conveyance belt S. Further, as the recording medium S, besides paper and textile, a resin film and metals can be used without being limited as described in the foregoing.

Above the conveyance belt 23 of the conveyance section 2, a main scanning section 3 is disposed. Inside the main scanning section 3, a carriage rail 31 in a shape a bar extending the main scanning direction X is disposed. On the carriage rail 31, a carriage 32 substantially in a shape of housing is supported so as to be able to reciprocate in the main scanning direction X. The carriage 32 moves in the main scanning direction X along the carriage rail 31 so as to perform scan via a scanning mechanism which includes an unillustrated motor.

Carriage 32 is equipped with a recording head 5 having a surface P (hereinafter called nozzle surface P) facing the recording medium S, on which a plurality of nozzles N to eject ink of each of colors, yellow (Y), magenta (M), cyan (C) and black (K) when recording an image, are disposed. Nozzles N on each recording head 5 eject an ink droplet of each color with respect to the recording medium on the conveyance belt 23.

Meanwhile, a configuration of the recording head 5 will be described later. To the carriage 32, there are connected a cable pair 33 including unillustrated piping to supply ink to the recording head 5 from an ink tank 81 to be described and unillustrated wiring to propagate electric signals and power to drive the recording head 5.

Also, in the present embodiment, as FIG. 1 shows, an end section of the main scanning section 3 in the main scanning direction X represents a maintenance section 6 to carry out maintenance of the recording head 5. Also another end side of the main scanning section 3 in the main scanning direction X represents a nozzle moisturizing section 7 to moisturize the nozzle surface P of the recording head 5 by a cap in a non-recording operation time so that failures of ink ejection from the nozzles N do not occur due to drying of the nozzles N of the recording head 5 in the non-recording operation time.

Further in the present embodiment, behind the main scanning section 3, an ink rack provided with the ink tank 81 to reserve ink of each color to be supplied to each recording head 5 is disposed. From each ink tank 81, ink is supplied to each recording head 5 via the aforesaid piping and an unillustrated ink supply pipe.

Further, below the main scanning section 3, the computer 4 for image processing is provided. The computer converts image data of an image inputted form an unillustrated external apparatus to be recorded on the recording medium S into data corresponding to each nozzle of the recording head 5. From the computer 4, the data is serially transferred to an unillustrated head drive circuitry to drive the recording head 5 via the aforesaid wiring. Incidentally, in the present embodiment, the computer 4 is configured with a general purpose computer in which an unillustrated CPU (Central Processing Unit), a ROM (Read Only Memory), a RAM (Random Access Memory) and an input and output interface are connected to a bus line.

Figure 3:
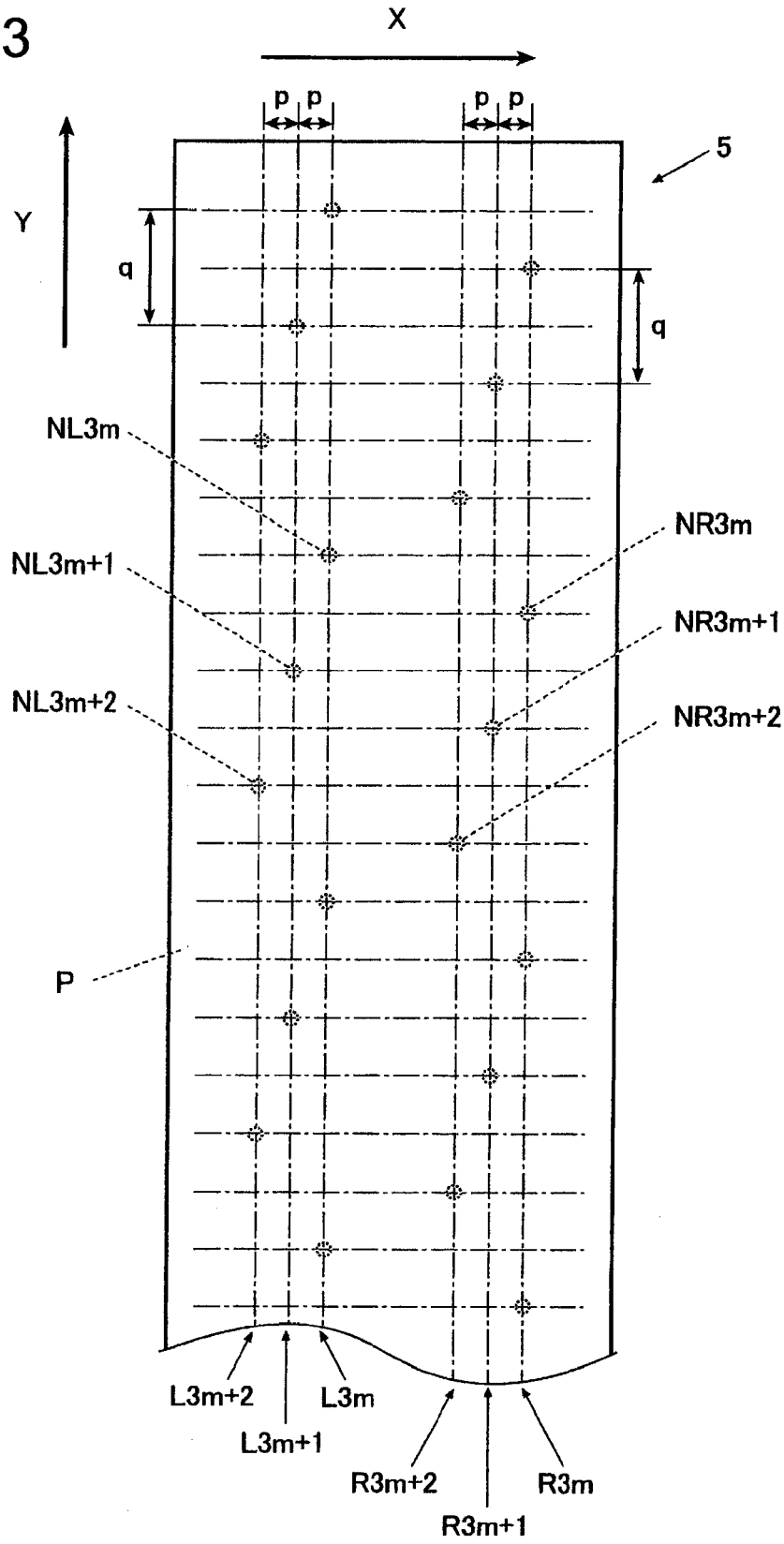
FIG. 3 is a plane view showing a configuration of a recording head.
Figure 24:
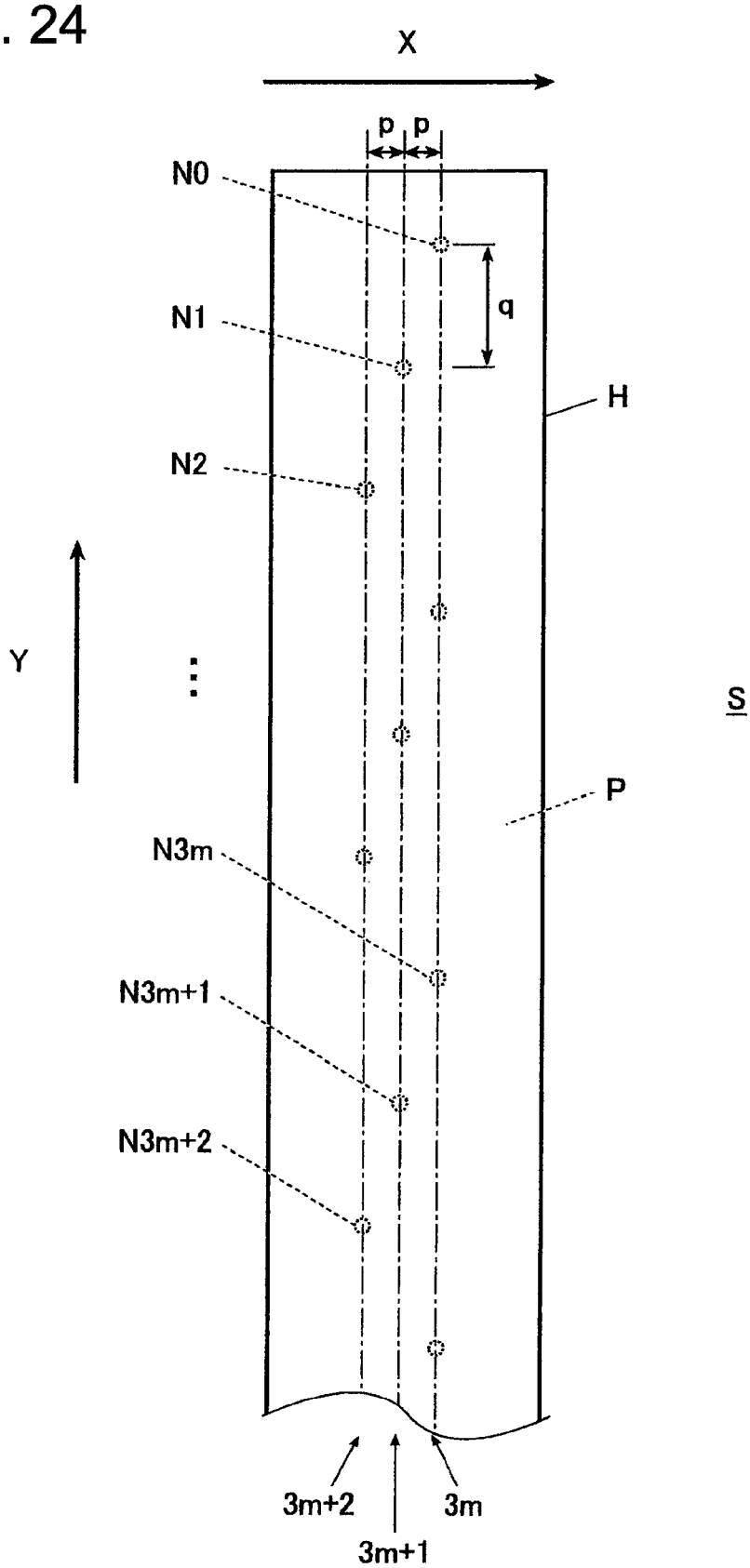
FIG. 24 is a plane view showing a configuration of a general recording head having three nozzle rows in a staggered arrangement.

As the recording head 5, it is possible to employ a general recording head H having three nozzle rows 3*m*, 3*m*+1 and 3*m*+2 wherein the plurality of the nozzles N3*m*, N3*m*+1 and N3*m*+2 are disposed in the staggered arrangement with an interval of L/3 in the main scanning direction X as FIG. 24 shows. However, in the present invention as the recording head 5, an existing recording head shown in FIG. 3 is used.

Specifically, the recording head 5 is driven by each drive phase of a three-phase current, and two sets of nozzle rows, which are configured with three rows having a plurality of the nozzles N disposed in the staggered arrangement with an interval of L/3 (L is a pixel pitch) in the main scanning direction X, are disposed in parallel in the main scanning direction X of the recording head 5. In the following, the nozzle rows which belong to a set on a right side in the figure are denoted as R3*m*, R3*m*+1 and R3*m*+2, and the nozzles which belong to the nozzle rows R3*m*, R3*m*+1 and R3*m*+2 are denoted as NR3*m*, NR3*m*+1 and NR3*m*+2. In addition, the nozzle rows which belong to a set on a left side in the figure are denoted as L3*m*, L3*m*+1 and L3*m*+2, and the nozzles which belong to the nozzle rows L3*m*, L3*m*+1 and L3*m*+2 are denoted as NL3*m*, NL3*m*+1 and NL3*m*+2.

In the present embodiment, an even number of 256 nozzles N are formed respecitvely for the left and right sets, namely a total of 512 nozzles N. Also, using the above recording head 5, the image is formed with a resolution of 360 dpi on the recording medium S. In the above case, since the pixel pitch L is 70.5 μm, the interval p among the three nozzle rows on left and right are set at ⅓ of the above pitch which is 23.5 μm.

Further, intervals between the corresponding left and right nozzle rows, namely nozzles rows R3*m* and L3*m*, R3*m*+1 and L3*m*+1, and R3*m*+2 and L3*m*+2 are set at 1.44 mm. Also, an ejection frequency f (namely an ejection frequency for each nozzle N) of each nozzle row of the recording head 5 in the present embodiment is set appropriately, for example, around 6.7 kHz.

Also, in the recording head 5 of the present embodiment, an interval q between each adjacent nozzle N in the same nozzle row set in the sub-scanning direction Y is set to be two times the pixel pitch L, namely 141 μm. In the left and right nozzle row sets, the nozzles N are displaced by one pixel pitch L in the sub-scanning direction Y.

Figure 4:
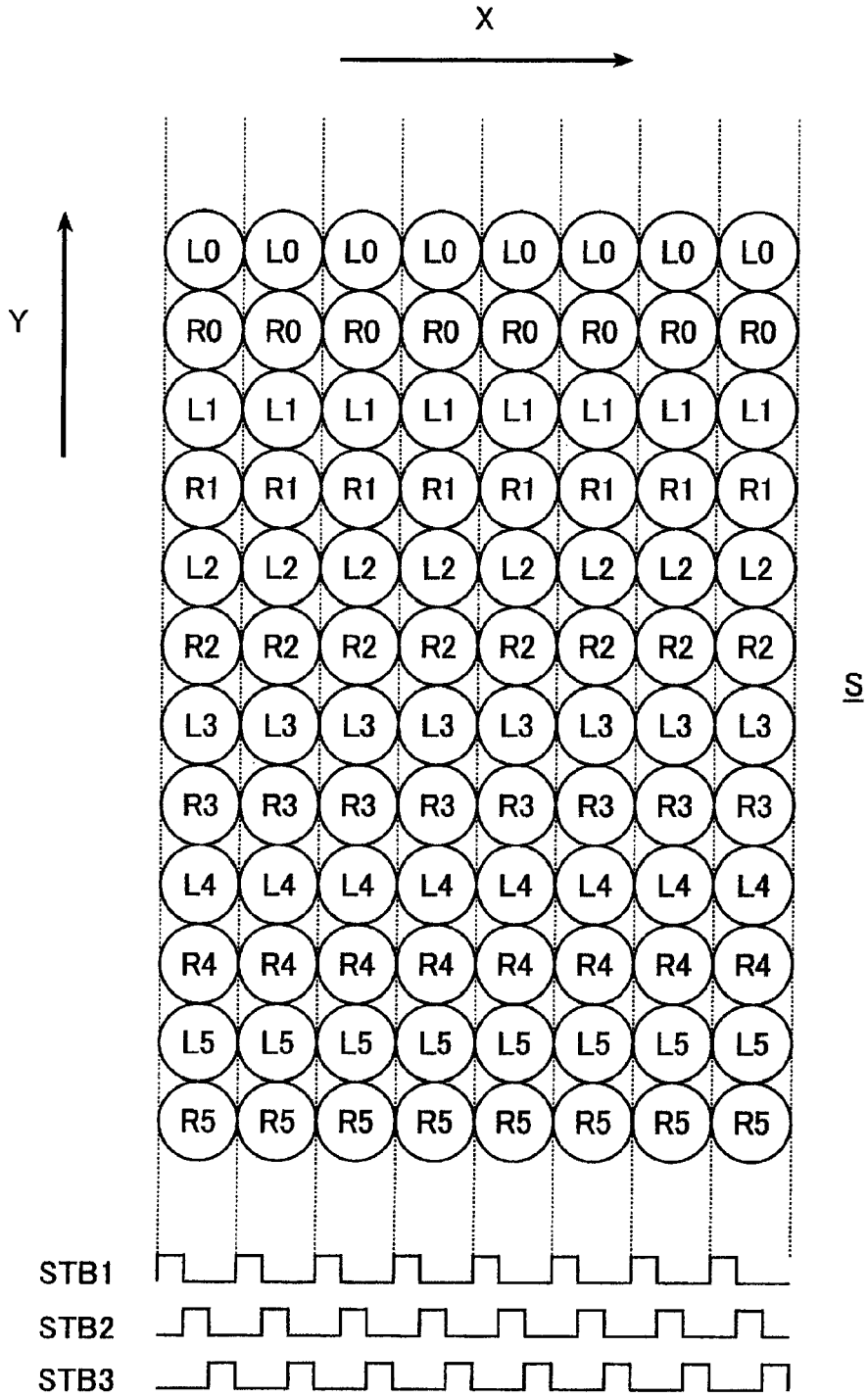
FIG. 4 PRIOR ART
FIG. 4 is a diagram showing pixel positions to which ink ejected via a conventional recording method lands and strobe pulses in a first embodiment.
Figure 25:
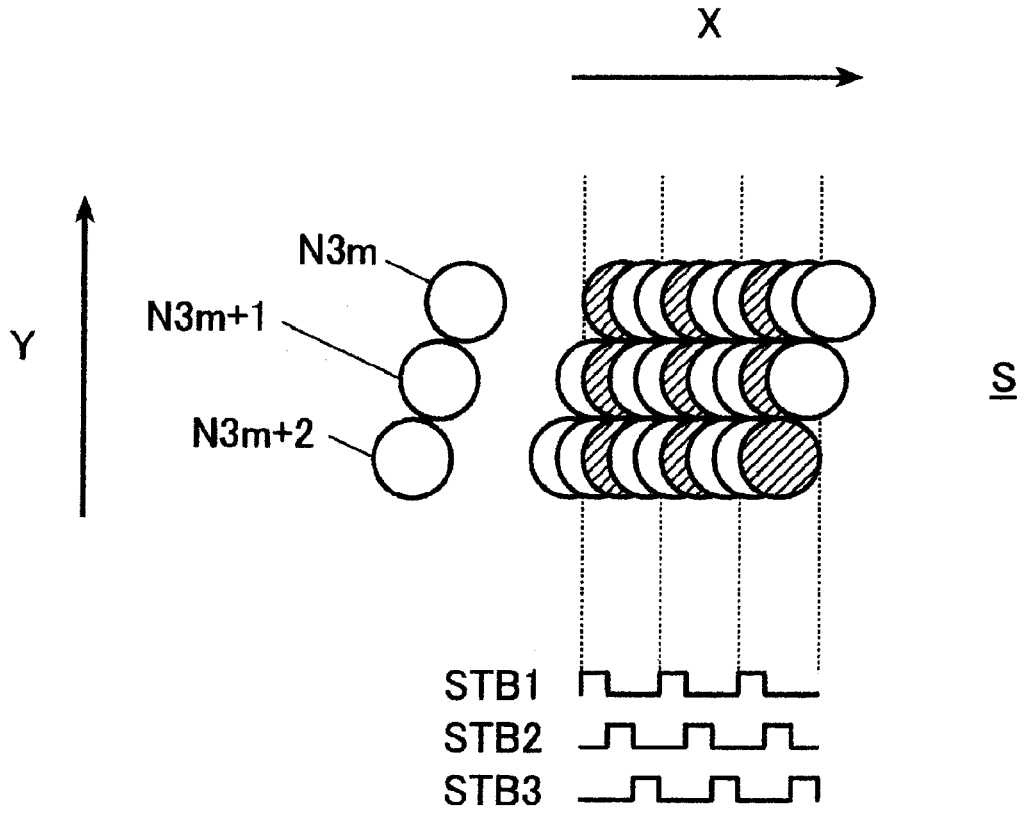
FIG. 25 is a diagram showing pixel positions on which ink lands in case ink is ejected in a conventional recording method using a recording head of FIG. 24 and strobe pulses.

Thus, if ejection drive is performed with three-phase drive, which has been performed conventionally, by moving the recording head 5 at a moving speed of L×f for scan, and by driving each of the nozzles NR3*m*, NR3*m*+1, and NR3*m*+2, and NL3*m*, NL3*m*+1 and NL3*m*+2 in the recording head 5 of the present embodiment to eject with normal phase as shown in FIG. 25 (namely, each nozzle row of the recording head 5 is driven to eject from a nozzle row in a front section to a nozzle row on a rear side successively in the relative moving direction (main scanning direction X) of the recording head with respect to the recording medium S), as FIG. 4 shows, the ink ejected from the nozzles NR3*m* to NR3*m*+2 and nozzles NL3*m* to NL3*m*+2 land at different positions respectively on the recording medium S through one scan by the recording head 5 in the main scanning direction X without landing at the sane position.

Figure 29:
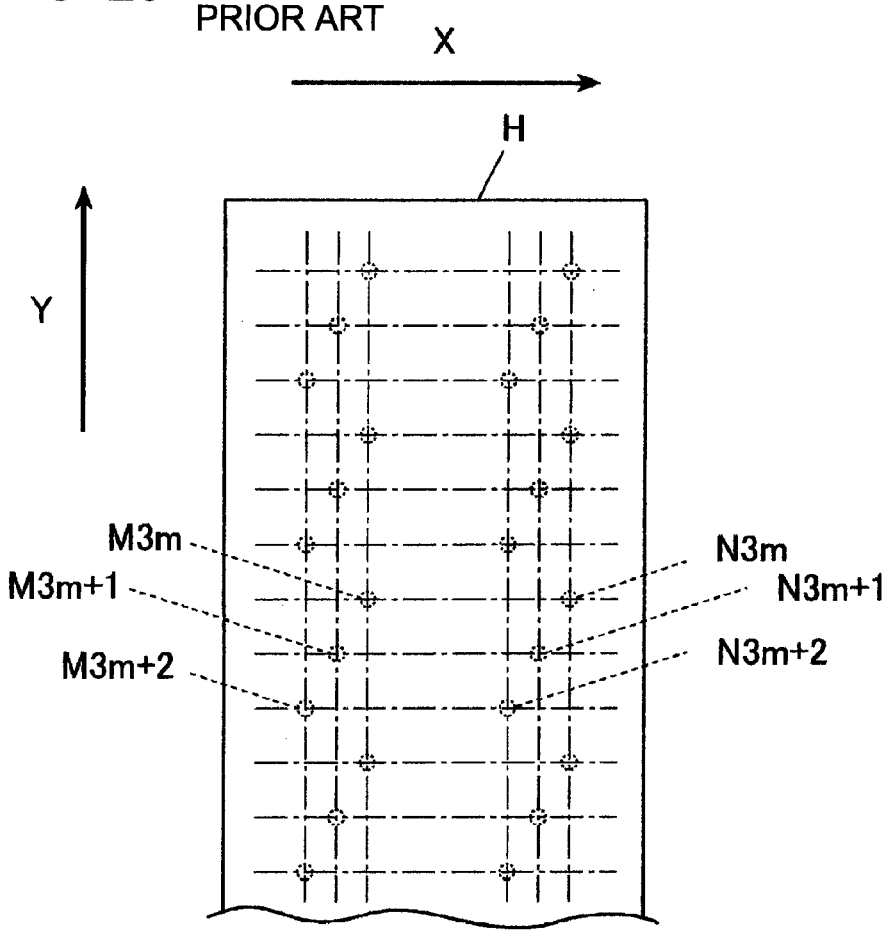
FIG. 29 PRIOR ART
FIG. 29 is a plane view showing a configuration having one recording head in which nozzle rows in staggered arrangements are disposed in parallel.
Figure 30:
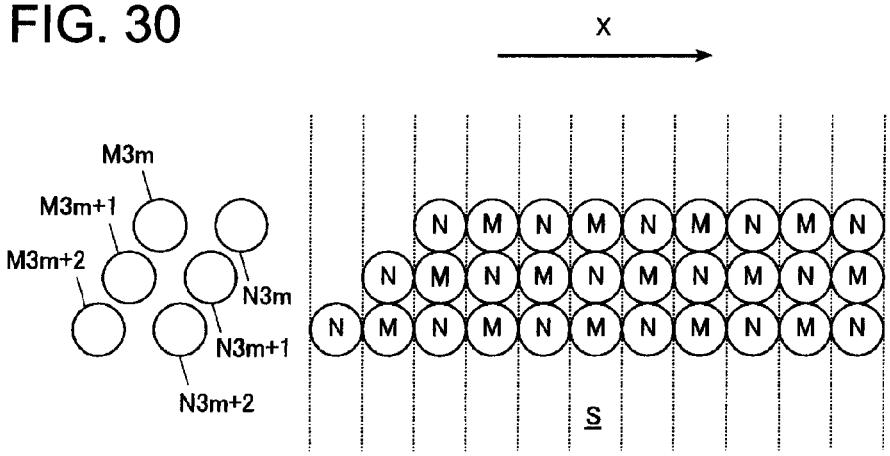
FIG. 30 is a diagram showing pixel positions on which ink lands in case ink is ejected using a recording head of FIG. 28 or 29.

As above, the recording head 5 of the present embodiment seems to be similar to the recording head H used in the inkjet recording apparatus in Patent Document 2 shown in FIG. 29, however, different from the recording head H shown in FIG. 29, the recording head 5 has the same function as that of the recording head H shown in FIG. 24 having three nozzle rows 3*m*, 3*m*+1 and 3 m+2 in which the plurality of the nozzles N3*m*, N3*m*+1 and N3*m*+2 are disposed in the staggered arrangement with the interval ⅓ in the main scanning direction X.

As FIG. 4 shows, the recording head 5 of the present invention can record the image on the recording medium S by landing ink on each pixel on the recording medium S through one scan (namely, one pass) in case ejection drive is conducted via three phase drive which has been conventionally carried out.

Figure 26:
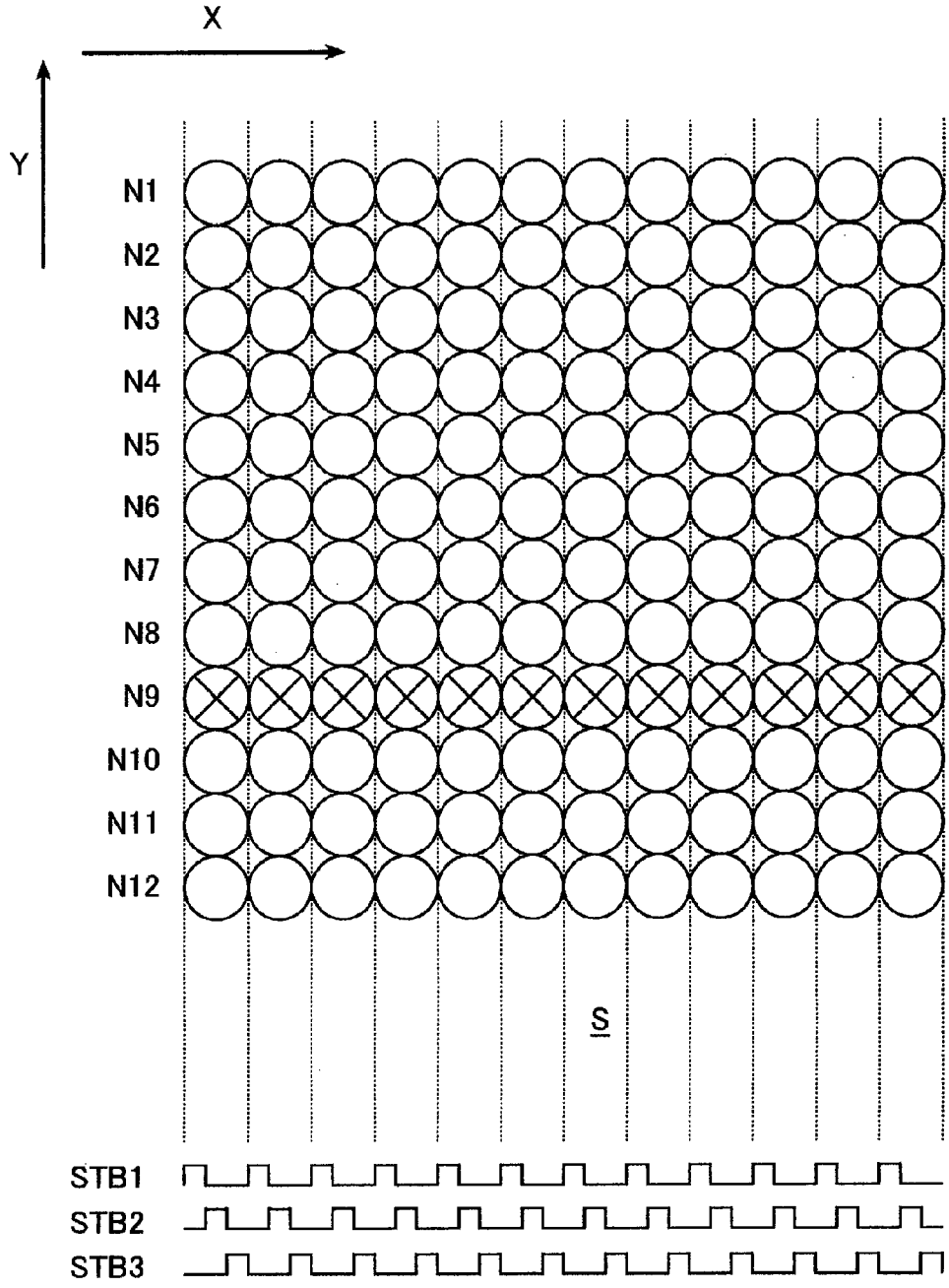
FIG. 26 is a diagram showing pixel positions in an image to which ink is not ejected from nozzles in case ink is ejected through a conventional recording method using a recording head of FIG. 25.

However, as FIG. 4 shows, if ejection drive is conducted by three phase drive having been carried out conventionally, as FIG. 26 shows, a streak pattern is created on the recorded image on the recording medium S and the image quality of the recorded image is deteriorated in case a nozzle failure occurs at a particular nozzle N and the particular nozzle N can not eject ink normally, which was described in the foregoing.

Figure 5:
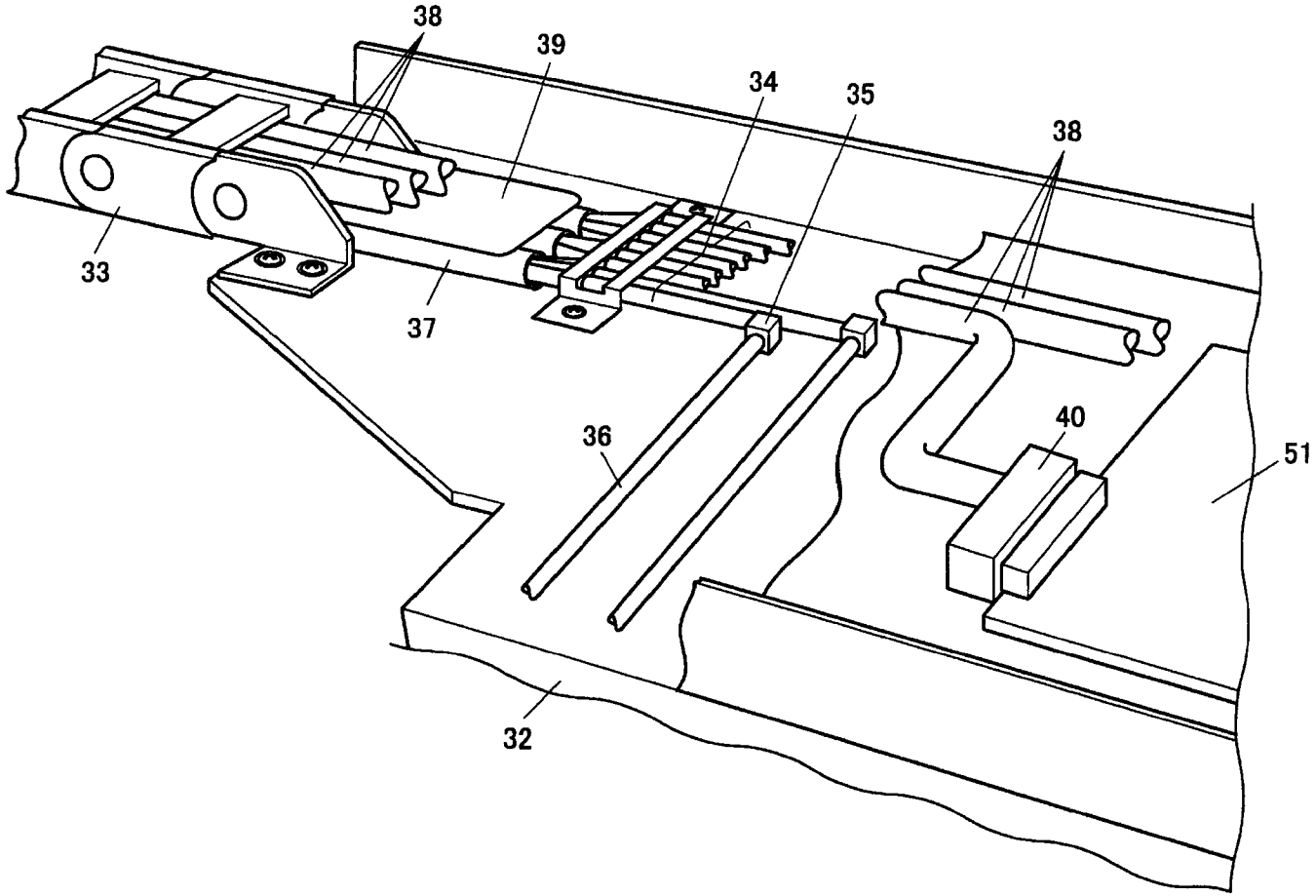
FIG. 5 is a schematic perspective view showing a configuration including a head drive circuitry at an upper section of a carriage.
Figure 6:
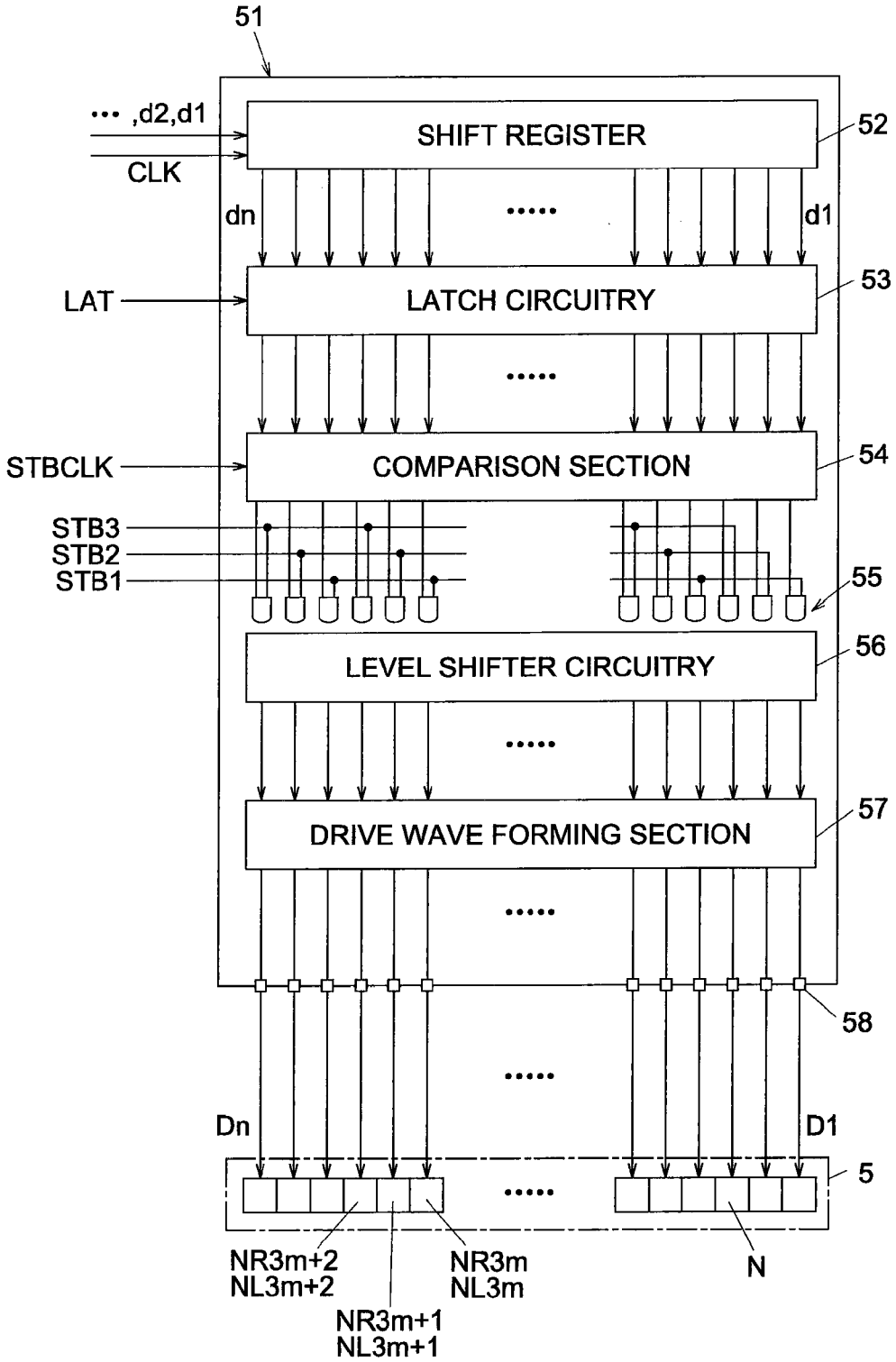
FIG. 6 is a block diagram showing a configuration of a head drive circuitry.

Incidentally, in the present embodiment, at an upper part of the carriage 32 shown by FIG. 2, as described in the foregoing, the cable pair 33 is connected. However, as FIG. 5 shows, the pipe 34 included in the cable pair 33 is connected with an ink supply tube 36 via a joint 35. Then the ink supply tubes 36 are connected with respective recording heads 5 which are omitted in FIG. 5, and the ink of each color supplied from an ink tank 81 (refer to FIG. 1) is supplied to each recording head 5 via the pipe 34 and the ink supply tube 36.

Also, in the present embodiment, the pipes 34 are included in resin tubes 37 by a predetermined number, and in the cable pair 33, a partition wall is disposed to divide the pipes 34 and the wires 38 so that they do not contact each other.

Further, the wires 38 are connected with the head drive circuitry 51 via a connector 40 so that data transferred serially from the computer 4 is transferred to the head drive circuitry 51.

The head drive circuitry 51 is configured with a shift register 52, a latch circuitry 53, a level shifter circuitry 56, a drive wave forming section 57 and so forth. When data d1, d2 . . . corresponding to respective nozzles N of the recording head 5 is transferred serially from the computer 4, the head drive circuitry 51 temporally stores the data d1, d2 . . . in the shift register 52 in accordance with a clock signal CLK.

Then, at the time when each data d1, d2 . . . , dn is stored in the shift register 52, a latch signal LAT is inputted to the latch circuitry 53, then at the above timing the latch circuitry 53 inputs the data d1, d2 . . . , dn from the shift register 52. Then processing such as rearranging of the sequence of the data is carried out as needed. Also, in the vacant shift register 52, a subsequent successive data is stored sequentially.

Then, the data d1, d2, . . . , dn outputted from the latch circuitry 53 is transmitted to a comparison section 54 and outputted from the comparison section 54 in accordance with the strobe clock STBCLK. The data d1, d2, . . . , dn outputted from the comparison section 54 is sent to each and-circuit 55. In the and-circuit 55, when either the data d outputted from the comparison section 54 or one of the strobe pulses STB1, STB2, and STB3 is ON, the data d is transferred from one and-circuit, where the strobe pulse is ON, to the level shifter circuitry 56.

Figure 27:
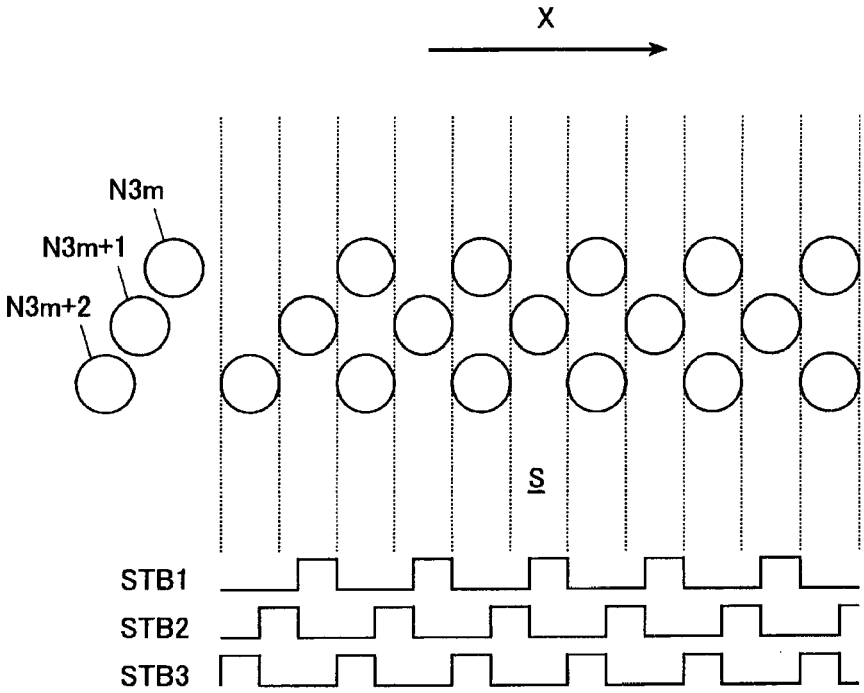
FIG. 27 is a diagram showing pixel positions on which ink lands in case ink is ejected through a recording method of Patent Document 2 using a recording head of FIG. 24.
Figure 28:
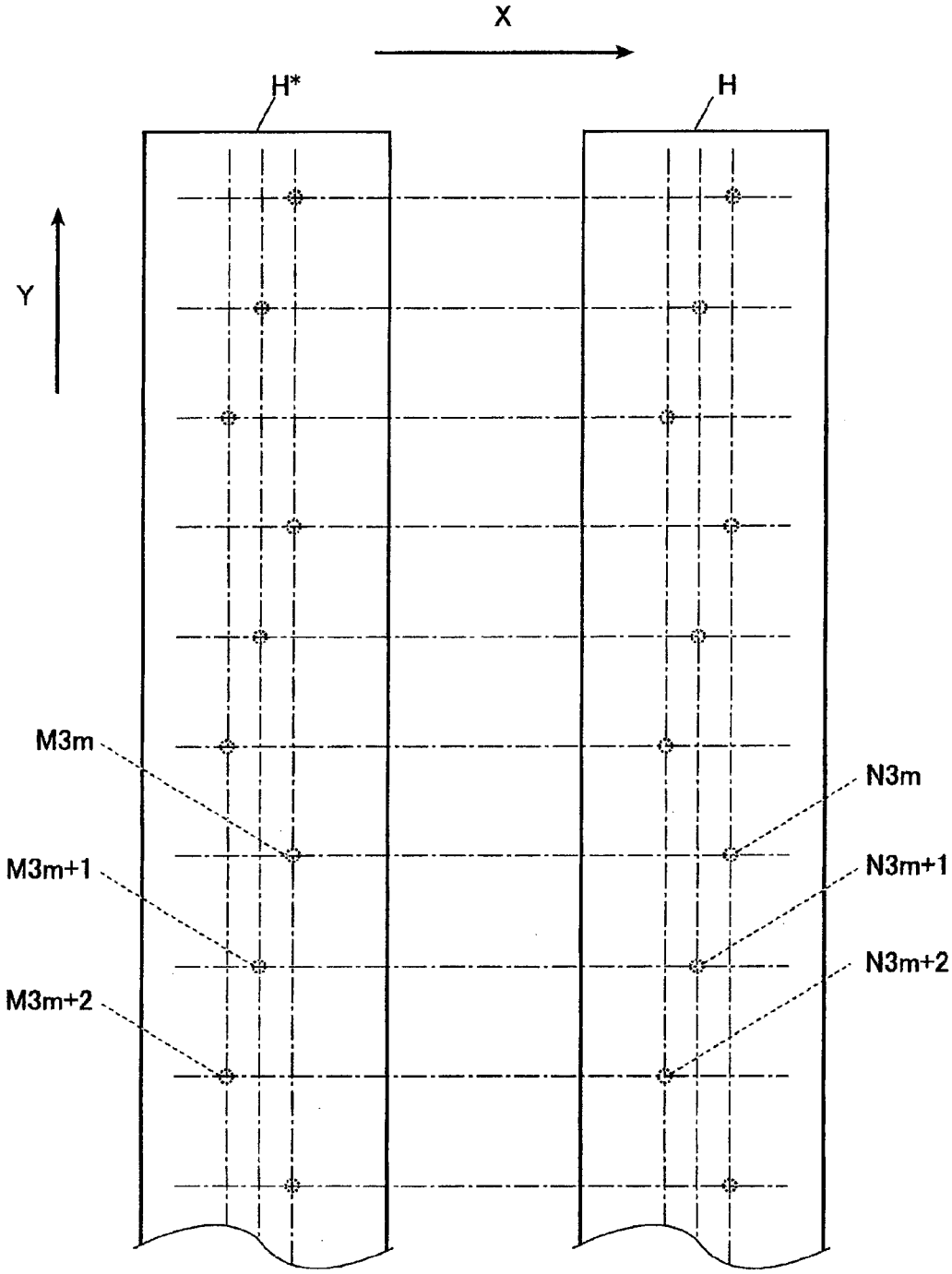
FIG. 28 is a plane view showing a configuration having two recording heads disposed in parallel in a main scanning direction.

Incidentally, in the same manner as the ones shown by FIG. 25 and FIG. 27, in the present embodiment, in case the strobe pulse STB1 is at high level, the nozzles NR3*m* and NL3*m* eject ink, in case the strobe pulse STB2 is at high level, the nozzles NR3*m*+1 and NL3*m*+1 eject ink, and in case the strobe pulse STB3 is at high level, the nozzles NR3*m*+2 and NL3*m*+2 eject ink, respectively.

Then as described later, by switching between the normal phase and the reverse phase with the strobe pulses STB1, STB2 and STB3, the nozzles NR3*m*, NR3*m*+1 and NR3*m*+2, and the nozzles NL3*m*, NL3*m*+1 and NL3*m*+2 of the recording head 5 are three-phase driven with the normal phase or the reverse phase.

Figure 7:
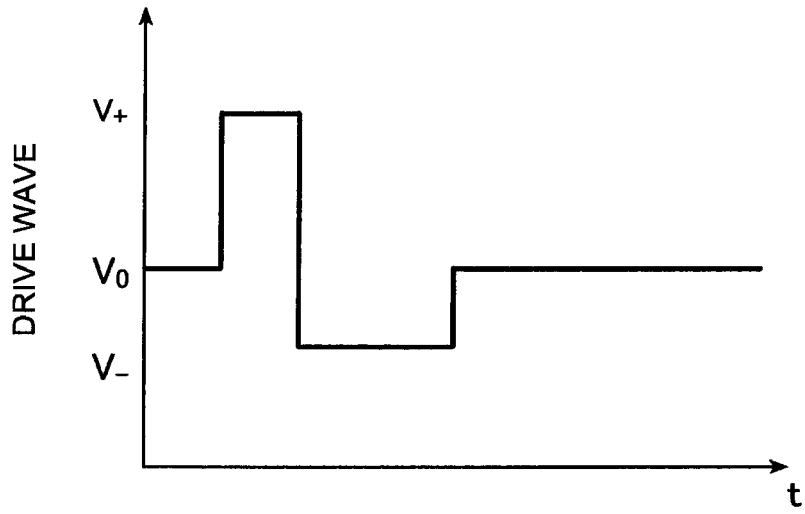
FIG. 7 is a diagram showing an exemplary drive wave of a nozzle drive signal.

The level shifter circuitry 56 is configured to transmit each items of data d1, d2, . . . , dn in accordance with up and down of the voltage to the drive wave forming section 57. The drive wave forming section 57 creates nozzle drive signals D1, D2, . . . D3 having, for example, a drive wave shape shown in FIG. 7 based on the data d1, d2, . . . , dn, and sends each of nozzle drive signals D1, D2, . . . , Dn sequentially to each nozzle N of the recording head 5 via each output terminal 58.

Also, as described in the forgoing, each nozzle N of the recording head 5 is three-phase driven, and in a state where a strobe pulse STB of high level is applied, when the aforesaid nozzle drive signal is applied, an unillustrated piezoelectric element of the nozzle N is deformed in accordance with the drive wave shape of the nozzle drive signal D, and then ink is ejected from the nozzle N.

Figure 8:
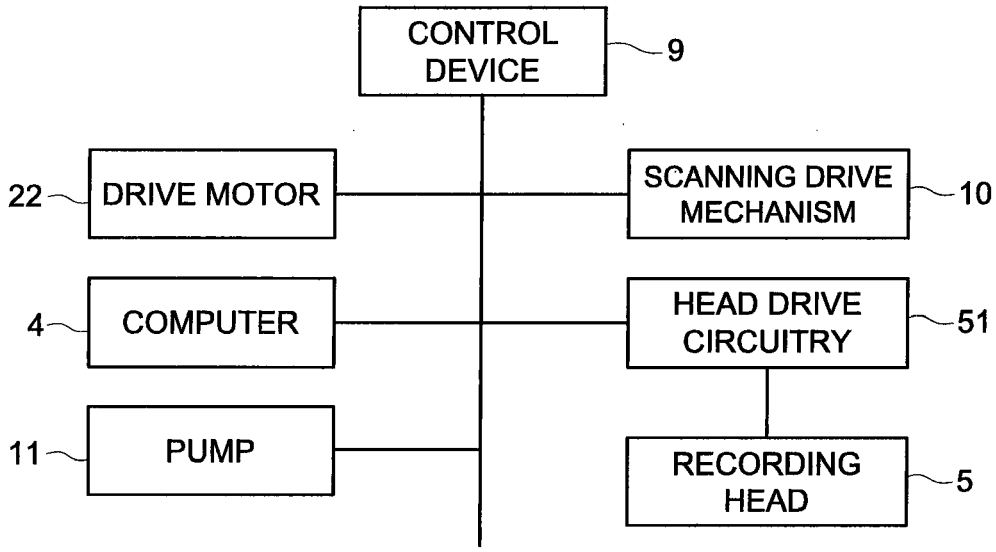
FIG. 8 is a block diagram showing a control configuration of an inkjet recording apparatus.

FIG. 8 is a block diagram showing a control configuration of an inkjet recording apparatus related to the present embodiment. An inkjet recording apparatus 1 is provided with a control device 9. While the control device 9 can be configured in the computer 4 described in the forgoing, it can be configured with a general use computer or a micro computer having an exclusive processor separated from the computer 4.

The control device 9 controls operation of each functional section of the apparatus. For example, it moves the carriage 32 (refer to FIGS. 1 and 2) in the main scanning direction X along the carriage rail 31, also as described in the forgoing, it drives the drive motor 22 in accordance with scan in the main scanning direction X by each recording head 5, which moves above the recording medium S in accordance with movement of the carriage 32, and it intermittently moves the conveyance belt 23 in a conveyance direction Z (sub-scanning direction Y) to convey the recording medium S intermittently.

Also, the control device 9, appropriately drives a pump 11 disposed in an ink supply system to supply ink to each recording head 5 from the ink tank 81 via the pipe 34 and ink supply tube 36. Further the control device 9 is provided with input devices such as an unillustrated mouse, key board and touch panel and configured so as to enable setting of an ejection frequency f for each nozzle row of the aforesaid recording head 5.

Further, the control device 9 controls the computer 4 so that each of the data d1, d2, . . . , dn, corresponding to each nozzle N of each recording head 5 with which the head drive circuitry 51 is associated, is transmitted serially.

On the other hand, via an input device, the control device 9 can assign whether the recording head 5 is moved to scan at a speed of L×f in the main scanning direction, and the drive phase of each nozzle in the nozzle row R3*m*, R3*m*+1 and R3*m*+2, and the nozzles row L3*m*, L3*m*+ and L3*m*+2 of the recording head 5 is switched to the normal phase, or the recording head 5 is moved at a speed of two times the conventional speed, namely 2×L×f, in the main scanning direction to scan and the drive phase of each nozzle in the nozzle row R3*m*. R3*m*+1 and R3*m*+2, and the nozzles row L3*m*, L3*m*+ and L3*m*+2 of the recording head 5 is switched to the reverse phase.

When the former conventional recording method is assigned, the control device 9 sets the moving speed of L×f in the main scanning direction X of the carriage 32 equipped with the recording head 5 in the scan drive mechanism 10, and the control device 9 sets the head drive circuitry 51 so that ejection drive of the nozzle rows R3*m* to R3*m*+2 and the nozzle rows L3*m* to L3*m*+2 of the recording head 5 is carried out in an order from the nozzle row in a front section to the nozzle row on a rear side in a relative moving direction (main scanning direction X) of the recording head 5 with respect to the recording medium S (namely ejection drive is carried out with the normal phase).

In case the nozzle rows R3*m* to R3*m*+2 and the nozzle rows L3*m* to L3*m*+2 of the recording head 5 are driven to eject with the normal phase, as described in the forgoing, when the recording head 5 performs one scan in the main scanning direction X, for example, scan is performed to the right side in the figure, the strobe pulse STB is changed in a sequence of STB1→STB2→STB3, and when the recording head 5 moves to the opposite direction in the main scanning direction X, for example, scan is performed to the left side in the figure, the strobe pulse STB to be applied to each nozzle N is changed in a sequence of STB3→STB2→STB1.

By setting as above, in the recording operation, the recording head 5 moves for scan in the main scanning direction X at the moving speed of L×f, and from each of nozzles NR3*m* to NR3*m*+2 and NL3*m* to NL3*m*+2 in the nozzle rows R3*m* to R3*m*+2 and the nozzle rows L3*m* to L3*m*+2, ink is ejected to the pixel positions corresponding to each nozzle N on the recording medium S as FIG. 4 shows. The ink is sequentially ejected to adjacent pixels in the main scanning direction X and the image is recorded on the recording medium S.

On the other hand, the recording method, in case the latter recording method is assigned, is the recording method of the present invention, and control of the control device 9 in the above case will be described. Also, operation of the inkjet recording apparatus 1 related to the present embodiment will be described at the same time.

Incidentally, as FIG. 3 shows since 256 nozzles are disposed respectively for left and right sets, total of 512 nozzles as shown in FIG. 3, will make the drawing complicated, so in FIGS. 9 to 15 including FIG. 4, description will be given assuming that six nozzles for each of left and right sets, the total of twelve nozzles (NL0 to NL5 and NR0 to NR5) record the image.

When the latter recording method representing the recording method of the present invention is assigned, the control device 9 sets the moving speed of 2×L×f of the carriage 32 equipped with the recording head 5 in the main scanning direction X in the scan drive mechanism 10, also the control device 9 sets the head drive circuitry 51 so that ejection drive of the nozzle rows R3*m* to R3*m*+2 and the nozzle rows L3*m* to L3*m*+2 of the recording head 5 is carried out in a sequence from the nozzle row on the rear side to the nozzle row in the front section in a relative moving direction (main scanning direction X) of the recording head 5 with respect to the recording medium S (namely ejection drive is carried out with the reverse phase).

In case the nozzle rows R3*m* to R3*m*+2 and the nozzle rows L3*m* to L3*m*+2 of the recording head 5 are driven to eject with the reverse phase, when the recording head 5 shown in FIG. 3 scans once in the main scanning direction X, for example, when the recording head 5 is moved to the left side in the figure for scan, the strobe pulse STB to be applied to each nozzle N is changed in a sequence of STB1→STB2→STB3, and when the recording head 5 is moved for scan in the opposite direction in the main scanning direction X, for example the recording head 5 is moved toward the left side in the figure for scan, the strobe pulse STB to be applied to each nozzle N is changed in a sequence of STB3→STB2→STB3.

By setting as above, at the recording operation, in accordance with the movement of the carriage 32 in the main scanning direction X along the carriage rail 31, the recording head 5 moves to scan in the main scanning direction X at the moving speed of 2×L×f.

Figure 9:
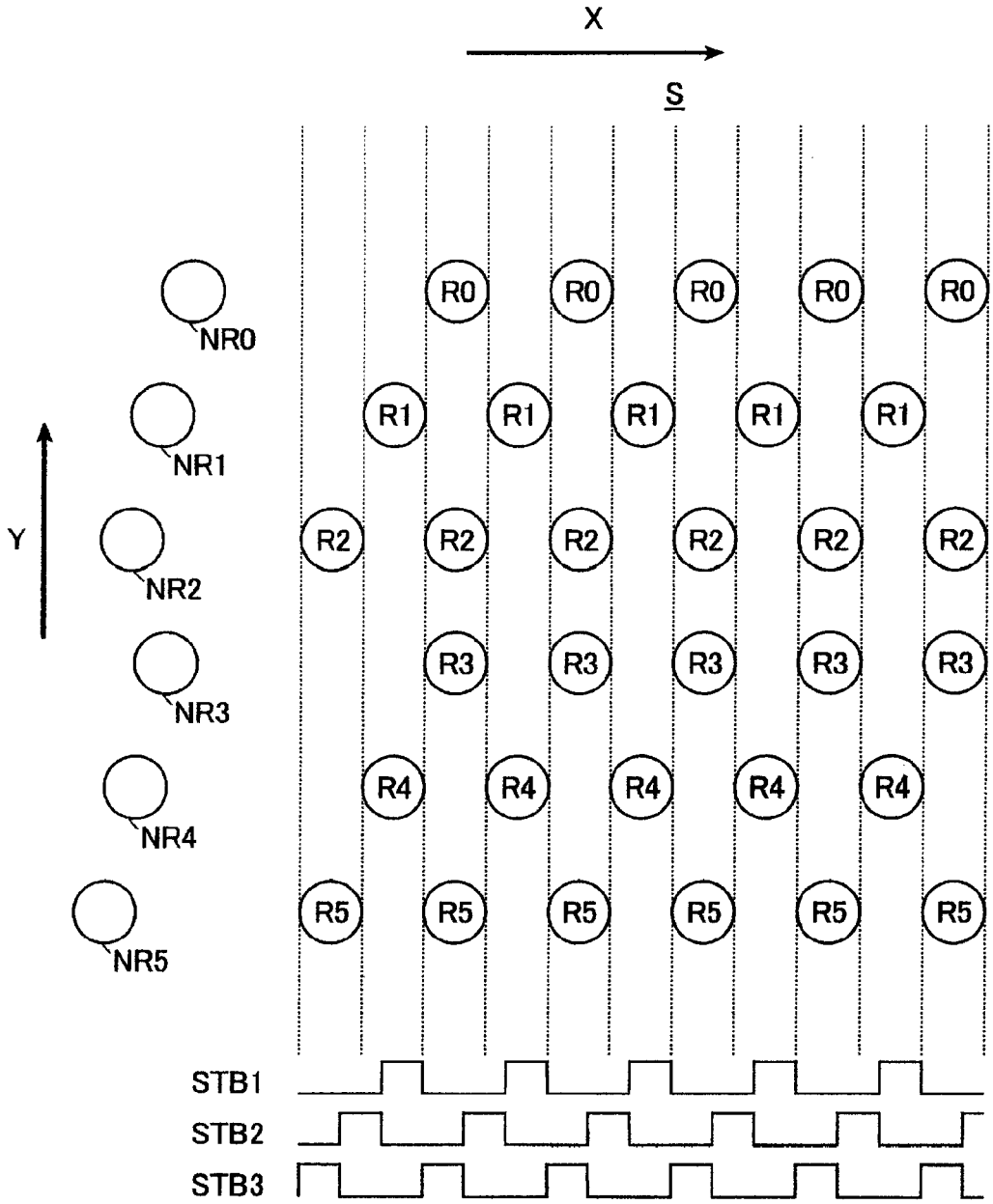
FIG. 9 is a diagram showing pixel positions to which ink lands, in case the ink is ejected from a right side ink row of a recording head in a recording method of the present invention in a first embodiment.

Also, in the same manner as the example shown in FIG. 27, from each of nozzles NR3*m*, NR3*m*+1 and NR3*m*+2 in nozzle rows R3*m*, R3*m*+1 and R3*m*+2, as FIG. 9 shows, the ink is ejected to every other pixel in the main scanning direction X at the respective corresponding pixel positions on the recording medium S. Also, as described in the forgoing, since the interval q in the sub-scanning direction Y between the adjacent nozzles N in each of nozzles NR3*m*, NR3*m*+1 and NR3*m*+2 is set to two times the pixel pitch L, the ink is ejected to every other pixel position in the sub-scanning direction Y as well.

Figure 10:
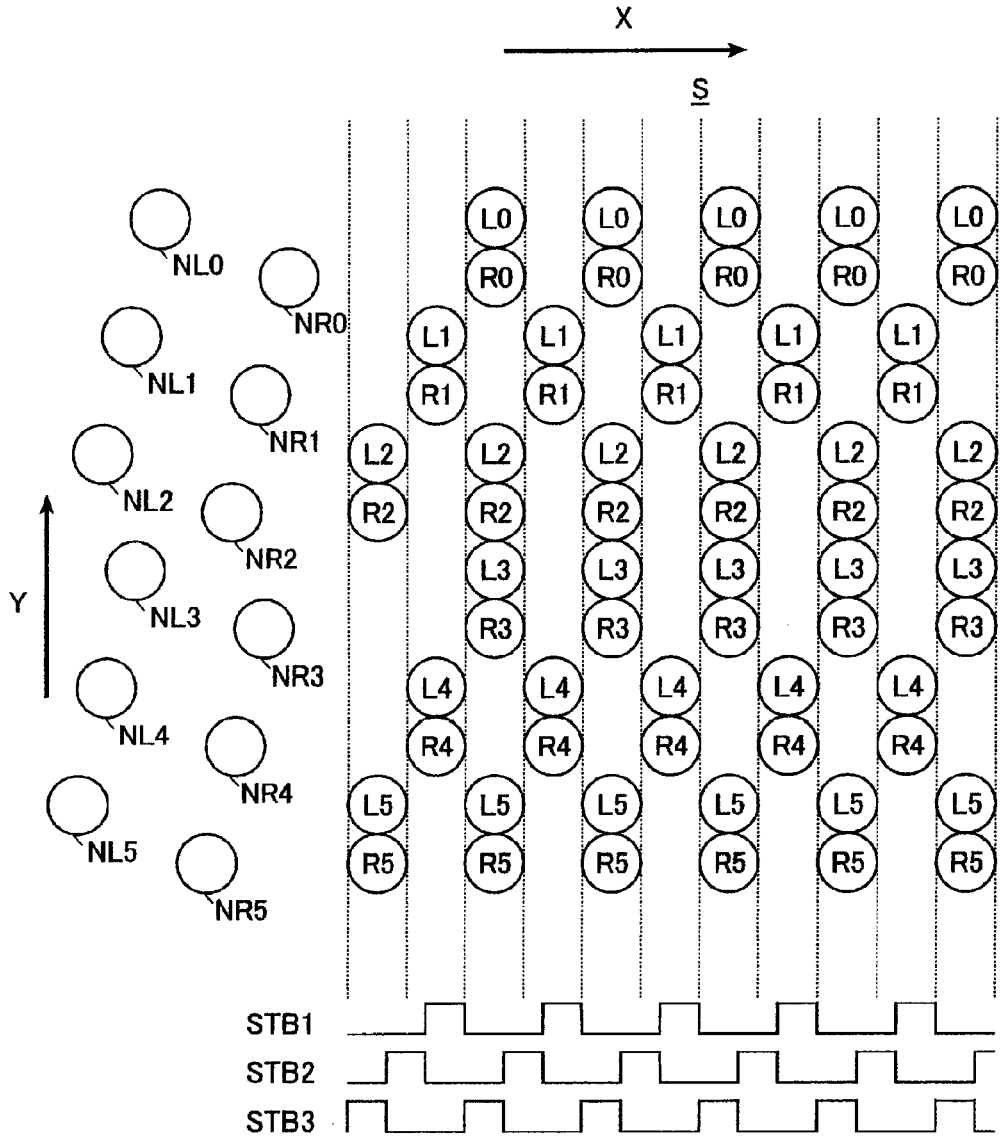
FIG. 10 is a diagram showing pixel positions to which ink lands, in case the ink is ejected from left and right ink rows of a recording head in a recording method of the present invention in a first embodiment.

Also, in the same manner, while the ink is ejected from the nozzles NL3*m*, NL3*m*+1 and NL3*m*+2 in the nozzle rows L3*m*, L3*m*+1 and L3*m*+2, since the nozzles NL3*m*, NL3*m*+1 and NL3*m*+2 are displaced by one pixel pitch L with respect to the nozzles NR3*m*, NR3*m*+1 and NR3*m*+2, from each of nozzles NL3*m*, NL3*m*+1 and NL3*m*+2 the ink is ejected to pixels positions adjacent to pixel positions to which the ink is ejected from each of nozzles NR3*m*, NR3*m*+1 and NR3*m*+2 in the sub-scanning direction Y as FIG. 10 shows.

When this occurs, after completion of one scan in the main scanning direction X by the recording head 5, if the ink is ejected from each nozzle N while the recording head is scanning in the opposite direction in the main scanning direction X without conveying the recording medium S in the conveyance direction Z (sub-scanning direction), the ink ejected from the same nozzle lands on the same positions in the sub-scanning direction Y on the recording medium S in the result. Thus, if nozzle failures occur in some nozzles in the nozzles N, streak patterns extending in the main scanning direction X appear at positions corresponding to the defective nozzles N in the recorded image on the recording medium.

Therefore, in the present invention, when the one scan by the recording head 5 in the main scanning direction X is completed, the control device 9 drives the drive motor 22 to move the recording medium S in the conveyance direction Z (sub-scanning direction Y) by a distance which is the pixel pitch multiplied by a predetermined value, and stops. In the subsequent scan in the opposite direction in the main scanning direction X by the recording head 5, the ink is ejected from each nozzle to a pixel position other than the pixel position at which the ink has landed in the preceding scan on the recording medium S.

Figure 11:
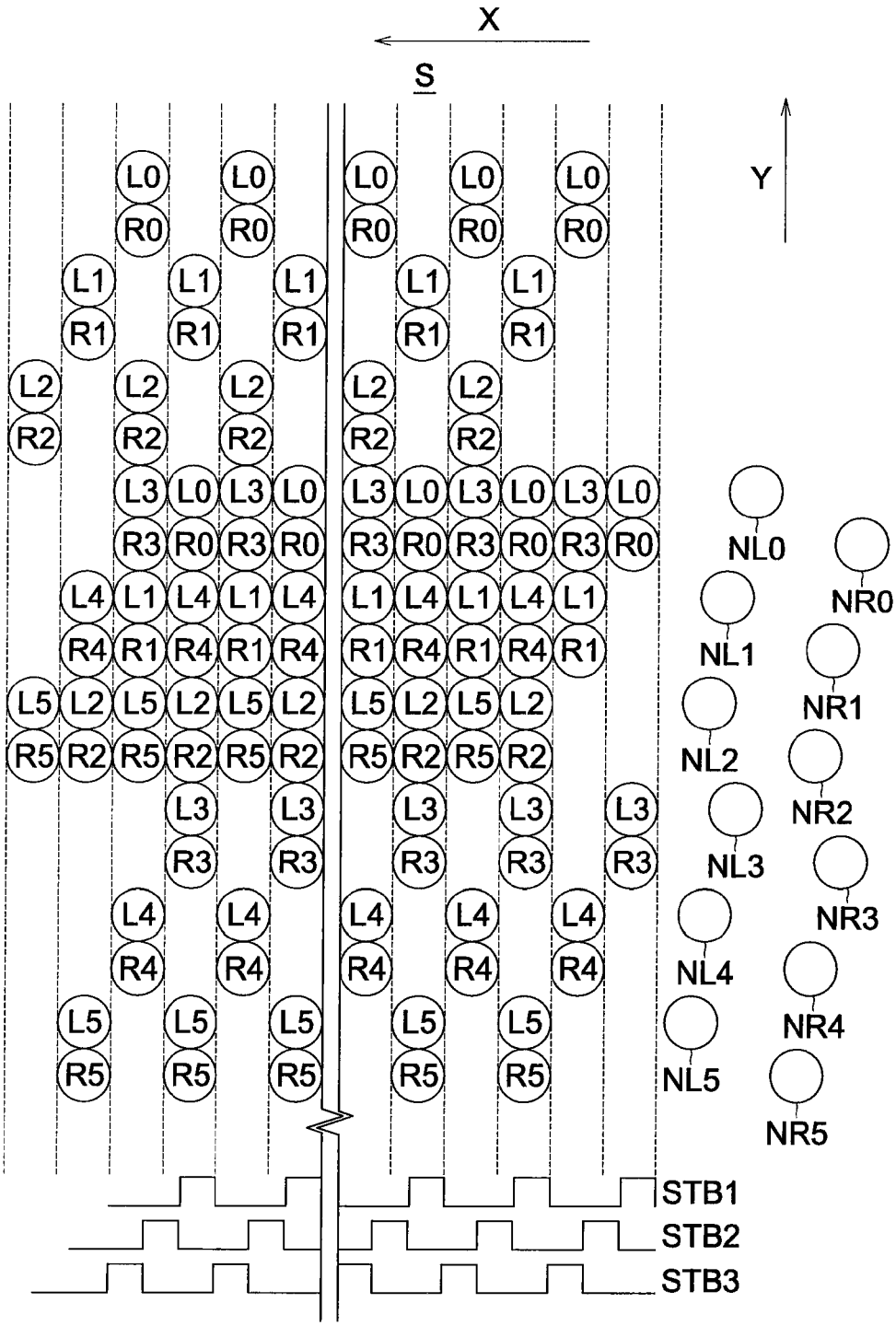
FIG. 11 is a diagram showing pixel positions in FIG. 10 and pixel positions to which the ink lands in scan by a recording head in an opposite direction.

For example, in case the ink is ejected to a pixel position on the recording medium S shown by FIG. 10 by one scan by the recording head 5 in the main scanning direction X, the control device 9 moves the recording medium S in the sub-scanning direction Y (for example upward direction in the figure) by a distance which is, for example, six times the pixel pitch, and stops. In the subsequent scan by the recording head 5 in the opposite direction in the main scanning direction X, as FIG. 11 shows, the ink is ejected from each nozzle to a pixel position which is adjacent to the pixel position on which the ink has landed in the preceding scan by the recording head 5 on the recording medium S. Incidentally, it is appropriately set that the recording medium S is conveyed in the sub-scanning direction Y by a distance equivalent to how many pixel pitches.

Supposing that the aforesaid moving distance is W1, since so-called multi-pass recording is conducted in the present embodiment, the moving distance W1 is preferably set so as to satisfy that W1≦W2×number of the nozzles. Incidentally, W2 is a distance between adjacent nozzles N in the sub-scanning direction Y in the recording head, and specifically, for example, a distance between NL0 and NR0.

Also, W2 is one time of the pixel pitch, supposing that the number of multi-passes is W3, W1 is preferred to be set so as to satisfy that W1=number of the nozzles×W2/W3.

In the present embodiment, as FIG. 11 shows, since W2 is one time of the pixel pitch, the number of nozzles is 12 and the number of multi-passes W3 is 2, the moving distance W1 is six times the pixel pitch.

As above, in the above example, through two scans by the recording head 5 (namely two passes), the ink can be landed each pixel on the recording medium S and the image can be recorded on the recording medium.

Figure 12:
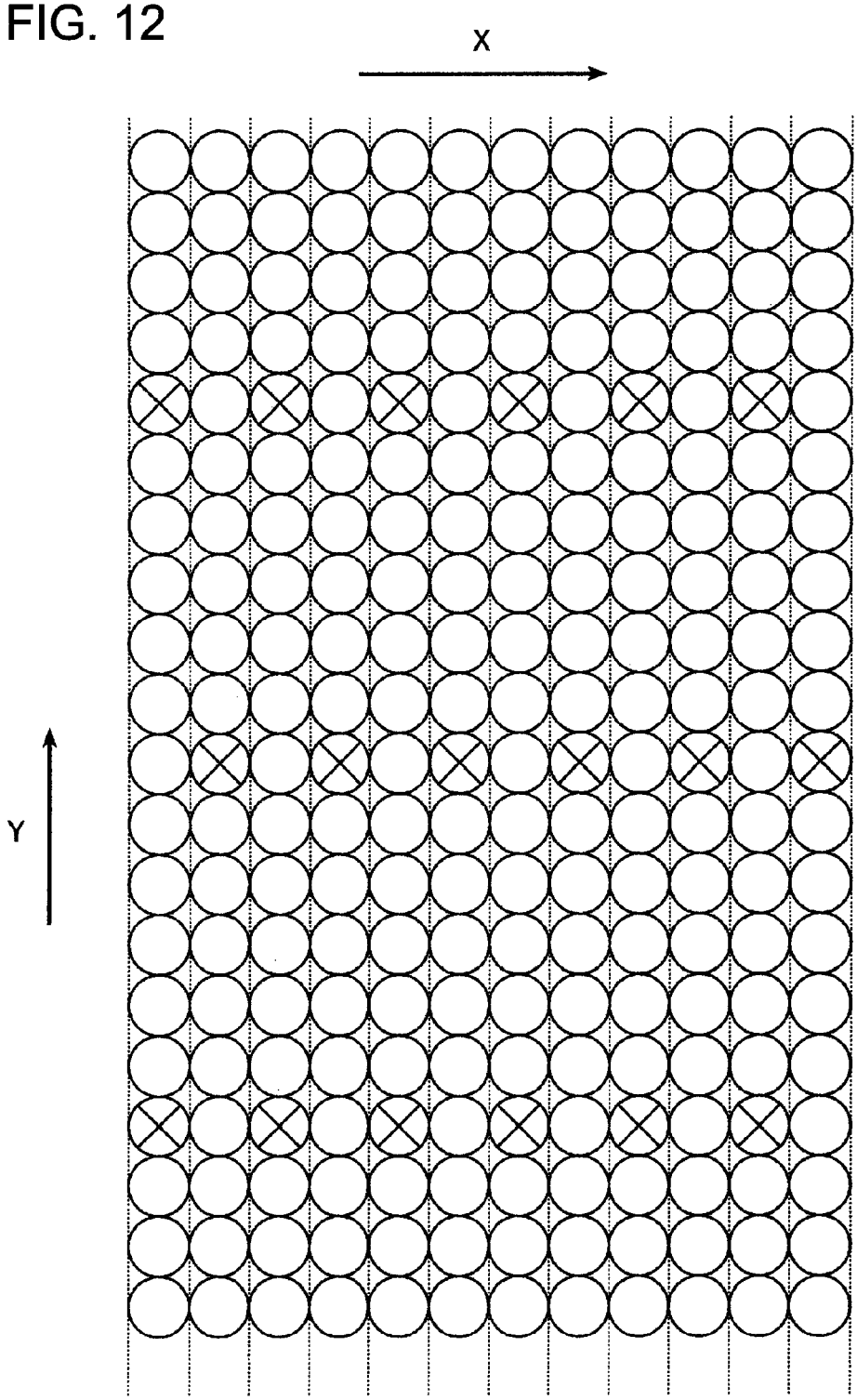
FIG. 12 is a diagram showing pixel positions in an image to which ink is not ejected from a nozzle in a first embodiment.

Also, when this occurs, as FIG. 11 shows, the ink ejected from the same nozzle N in the recording head 5 does not land at least at an adjacent pixel position on the recording medium S, thus even if there exist some of the nozzles N which do not eject ink normally due to the nozzle failure, as FIG. 12 shows, since the ink ejected from other normal nozzle N lands and fills the pixel position adjacent to the pixel position to which the ink has not been ejected from said nozzle is supposed to land, the portions to which the ink is not ejected are prevented from lining up serially in the main scanning direction X in the recorded image on the recording medium S, and thus a phenomenon that the streak pattern appears in the image is prevented and the deterioration of image quality is obviated.

Incidentally, as the recording method in the present invention, in case that the recording head 5 scans in the main scanning direction at the moving speed of 2×L×f and the nozzle rows R3*m* to R3*m*+2 and the nozzle rows L3*m* to L3*m*+2 are driven to eject by the reverse phase, the pixel positions to which the ink ejected from each nozzle N of the recording head 5 lands become scattered, for example as FIG. 10 and FIG. 11 show. Thus a sequence of the data when each item of data corresponding to each nozzle N of the recording head 5 is serially transferred from the computer 4 to the head drive circuitry 51 has to be rearranged appropriately.

Figure 13:
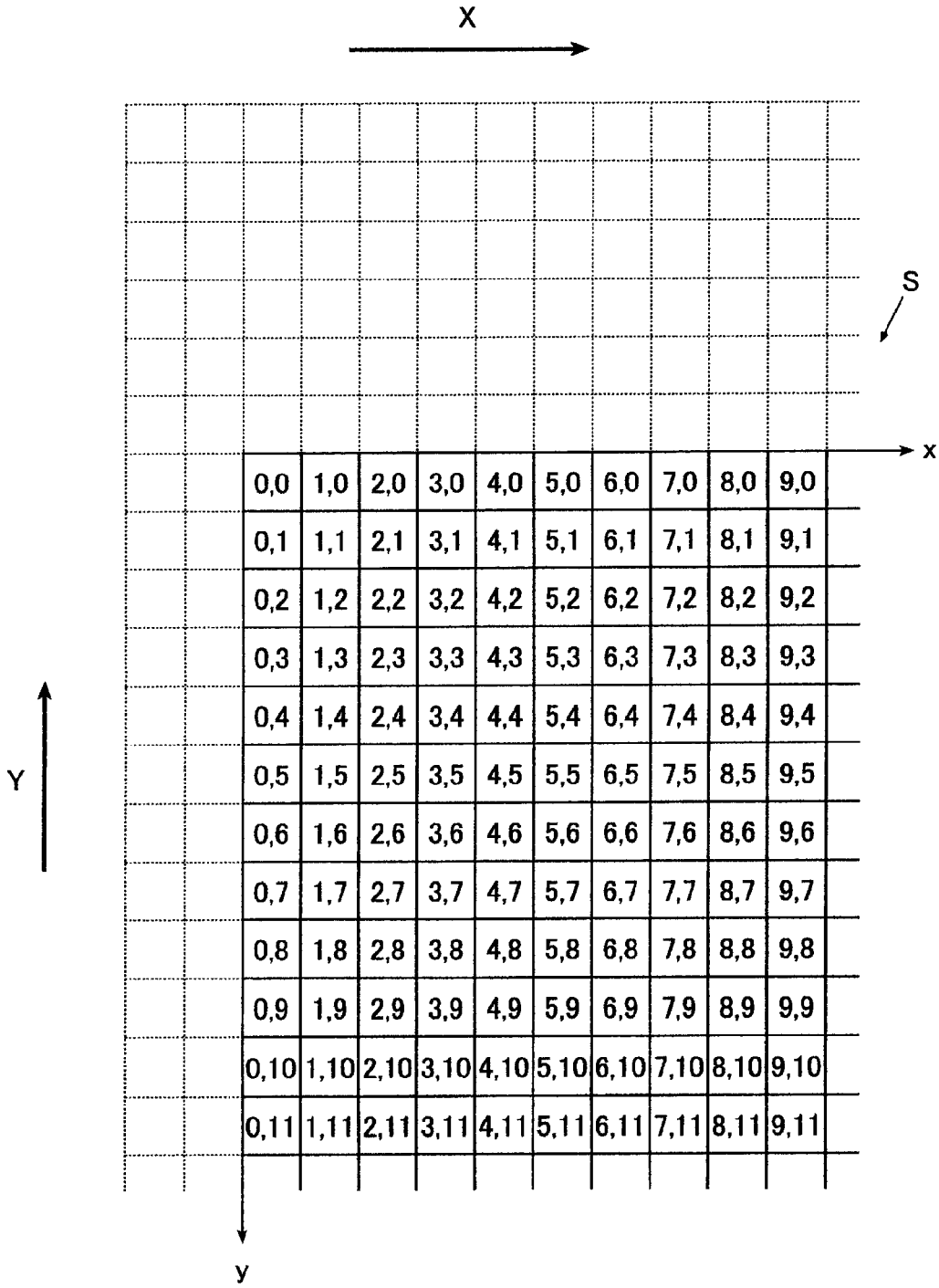
FIG. 13 is a diagram showing a position of an image to be recorded on a recording medium and a coordinate of each pixel position in an example in FIG. 12.
Figure 14:
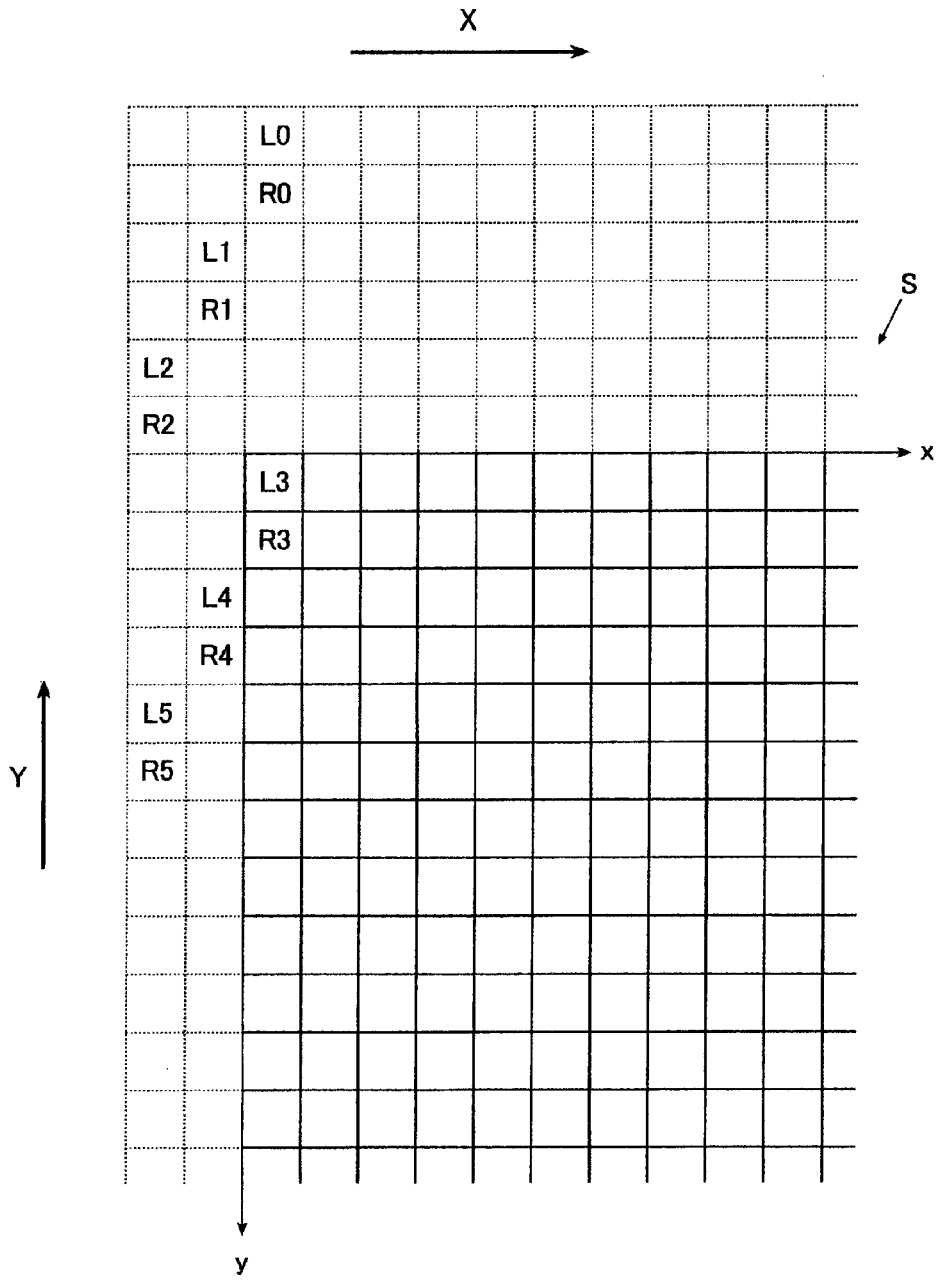
FIG. 14 is a diagram showing pixel positions to which ink ejected from each of the nozzles lands in a first ejection cycle in FIG. 13.

In the above example, as FIG. 11 reveals, the image recorded on the recording medium S has an area having an upper end represented by a pixel row denoted by the ink L3, L0, L3, L0, L3, L0 . . . extending in the main scanning direction X and a left end represented by a pixel row denoted by the ink L3, R3, L1, R1, L5, R5 . . . extending in the sub-scanning direction Y. As FIG. 13 shows, based on the pixel position of the ink L3 at an upper left corner in the above image, an X axis is set in parallel to the main scanning direction X, and a Y axis is set in parallel to the sub-scanning direction Y so that each pixel position of the image recorded on the recording medium S is described by a coordinate (x, y). Also, data corresponding to the nozzle N to eject the ink to the pixel position described by the coordinate (x, y) is denoted by d (x, y).

The computer 4 downloads each item of data d (x, y) which is converted from image data inputted from an unillustrated external apparatus to be recorded to a form corresponding to each nozzle N of the recording head 5 on the RAM. In case, for example, the ink is ejected from each nozzle N as FIG. 10 shows, first of all, the ink ejected from the nozzles NR0, NR1, NR3, NR4, NR5 . . . . In the first cycle lands at each of pixel positions R0, R1, R2, R3, R4, R5, . . . , shown by FIG. 14. Thus the computer 4 arranges each item of the data 0, 0, 0, d(0, 1), 0, 0 . . . so as to correspond to each of the nozzles NR0, NR1, NR2, NR3, NR4, NR5, . . . in sequence.

In the same manner, the computer 4 arranges each item of the data 0, 0, 0, d(0, 0), 0, 0 . . . so as to correspond to each of the nozzles NL0, NL1, NL2, NL3, NL4, NL5, . . . in sequence. Then each item of data is connected to be arranged in a form of 0, 0, 0, d(0, 1), 0, 0 . . . 0, 0, 0, d(0, 0), 0, 0 . . . . Incidentally, the data having a value of 0 is so-called dummy data which denotes that ink is not ejected.

Figure 15:
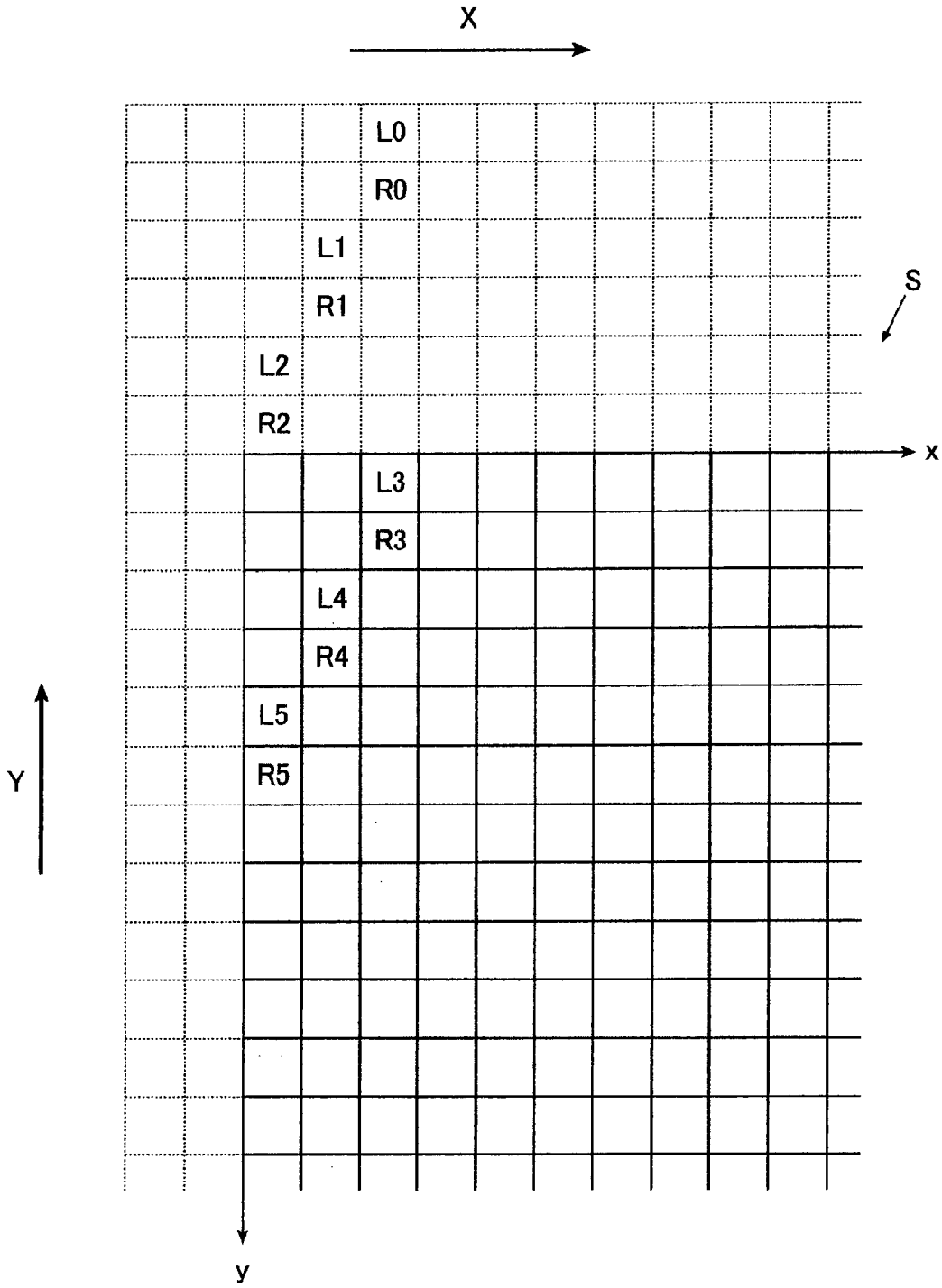
FIG. 15 is a diagram showing pixel positions to which ink ejected from each of the nozzles lands in a second ejection cycle in FIG. 13.

Also, since the ink ejected from the nozzles NR0, NR1, . . . , NL0, NL1, . . . , in the subsequent ejection cycle lands on each of pixel positions R0, R1, . . . , L0, L1 shown in FIG. 15, the computer 4 arranges each item of the data 0, 0, 0, d(2, 1), d(1,3), d(0,5), . . . so as to correspond to each of the nozzles NR0, NR1, NR2, NR3, NR4, NR5, . . . in sequence, and arranges and connects each item of the data 0, 0, 0, d (2, 0), d(1, 2), d(0, 4), . . . so as to correspond to each of the nozzles NR0, NL1, NL2, NL3, NL4, NL5, . . . in sequence.

As above, the computer 4 arranges the data d(x, y) corresponding to each pixel position on which the ink ejected from each of the nozzles NR0, NR1, NL0, NL1, . . . in each ejection cycle, or arranges each item of data by corresponding 0 which is the dummy data in case the data does not exist for the corresponding pixel position, and forms a data row having an appropriate arrangement sequence then transmits the data to the head drive circuitry 51 serially. Incidentally, forming of the data row can be conducted before recording operation starts, or can be conducted parallel to the recording operation.

Incidentally, the above process in the control device 9 and the process in the computer 4 are not specific processes for the recording head 5 shown by FIG. 3, and the same processes can be applied to a case that the general recording head H shown in FIG. 24 is used.

As above, according to the inkjet recording apparatus 1 related to the present embodiment, in the inkjet recording apparatus of serial head method using the recording head 5 or the recording head H having the nozzles N in the staggered arrangement, the recording head 5 or H moves to scan at the moving speed (2×L×f) which is two times the conventional moving speed (L×f), and each nozzle row of the recording head 5 or H are driven to eject in the sequence from the nozzle row at the rear section to the nozzle row on the front side in the relative moving direction (main scanning direction X) of the recording head 5 or H with respect to the recording medium S, namely driven to eject with the reverse phase.

Further, when the one scan in the main scanning direction X by the recording head H or 5 is completed, the recording medium S is moved by a distance which is the predetermined multiple of the pixel pitch L so as to execute the subsequent scan. Thus, the ink is ejected from each of the nozzles N to the pixel positions other than the pixel positions on which the ink has landed through the preceding scan by the recording head 5 or H on the recording medium S.

Therefore, even if some of the nozzles N which cannot eject ink normally due to the nozzle failure exist, the ink droplets ejected from other normal nozzles N land and fill the pixel positions adjacent to the pixel positions on which the ink has not been ejected from the said nozzles N supposed to land. Thus it is prohibited that the portions to which the ink has not been ejected line up serially in the recorded image on the recording medium in the main scanning direction X and the phenomenon that the streak pattern appears in the image is prevented. As the result, deterioration of the image quality is suppressed and the image quality can be improved.

Since the above effect can be achieved by the existing recording head such as the recording head 5 shown in FIG. 3 and the recording head H shown by FIG. 24, it is not necessary to provide another recording head in parallel or to use an exclusive recording head as the inkjet recording apparatus disclosed in Patent Document 2. Thus increase of manufacturing cost can be avoided and the cost can be reduced.

Further, in the conventional recording method shown in FIG. 4, though the image can be recorded via one scan (so-called one pass) of the recording head 5 or H on the recording medium S, in the recording method of the present invention shown by FIG. 11, two scans (so-called two-pass) by the recording head 5 or H is necessary to record the image on the recording medium S.

However, since the moving speed of the recording head 5 or H becomes two times the conventional moving speed in the main scanning direction X, the time required for image recording does not change much compared to the conventional recording method. Namely, according to the present invention, in the almost same recording time as that of the conventional method, the streak shape pattern can be prevented from appearing in the image, which cannot be prevented in the conventional recording method.

Meanwhile, in the recording head 5 (refer to FIG. 3) related to the present embodiment, as described in the forgoing, the interval between the left and right nozzle rows corresponding, namely the interval between the nozzle row R3*m* and the nozzle row L3*m*, is set at 1.44 mm, then since the pixel pitch L is 70.5 μm, the interval corresponds to approximately 20.4 pixels.

As above, since the interval between the nozzle row R3*m* and the nozzle row L3*m* are not set at an integral multiple of the pixel pitch L, for example, in case ejection timings of the nozzle rows R3*m* to R3*m*+2 and the nozzle rows L3*m* to L3*m*+2 are synchronized to eject the ink from each nozzle N, the landing position of the ink ejected from each nozzle N in the nozzle rows R3*m* to R3*m*+2 and the landing position of the ink ejected from each nozzle N in the nozzle rows L3*m* to L3*m*+2 do not align each other in the sub-scanning direction Y as FIG. 10 and FIG. 11 show.

To avoid the above state, for example, there can be a configuration that the ink is ejected from each nozzle N in dependent timings without synchronizing the ejection timings of the nozzle rows R3*m* to R3*m*+2 and the nozzle rows L3*m* to L3*m*+2.

However, there is a case that each nozzle N of the nozzle rows R3*m* to R3*m*+2 and the nozzle rows L3*m* to L3*m*+2 is not driven to eject at the dependent ejection timing. In the above case, it is possible that an ejection frequency f for each nozzle row (namely the ejection frequency for each nozzle N) of the recording head 5 is adjusted so as to align the landing positions of the ink ejected from each nozzle N of the nozzle rows R3*m* to R3*m*+2 and the landing positions of the ink ejected from each nozzle N of the nozzle rows L3*m* to L3*m*+2 in the sub-scanning direction Y. Incidentally in the above case, the moving speed (2×L×f) of the recording head 5 is changed in accordance with the change of the ejection frequency f.

Second Embodiment

In the inkjet recording apparatus related to the second embodiment, there will be described a case that a recording head 5 capable of recording an image having a higher resolution is used as the recording head 5.

Specifically, the recording head 5 (refer to FIG. 3) is driven by each drive phase of a three-phase current. Two sets of three nozzle rows, having a plurality of nozzles N in the staggered arrangement with an interval of L/3 (L is the pixel pitch) in the main scanning direction X, are disposed in parallel in the main scanning direction X of the recording head 5, which is the same formation as that of the first embodiment 256 nozzles N are disposed respectively for left and right sets, namely a total of 512 nozzles are disposed. In the present embodiment, the image is recorded on the recording medium S using the above recording head 5, with a resolution of 720 dpi, namely image forming can be conducted with two times the resolution of the first embodiment.

Therefore, the pixel pitch L is 35.3 μm and the intervals q between the three nozzle rows on left and right are set at ⅓ of the pitch, namely 11.8 μm respectively. Incidentally, an interval between left and right nozzle rows corresponding, namely the interval between the nozzle row R3*m* and the nozzle row L3*m* is 1.44 mm and the frequency f for each nozzle row (namely the ejection frequency for each nozzle N) is set, for example, at around 6.7 kHz, which are same as the first embodiment.

Also, in the recording head 5 of the present embodiment, the interval q between each of the adjacent nozzles in the same set of the nozzle rows in the sub-scanning direction Y is set at four times the pixel pitch L, and in the left and right sets of the nozzles rows, the nozzles N are displaced by two times the pixel pitch L in the sub-scanning direction Y, which is different from the first embodiment.

Figure 16:
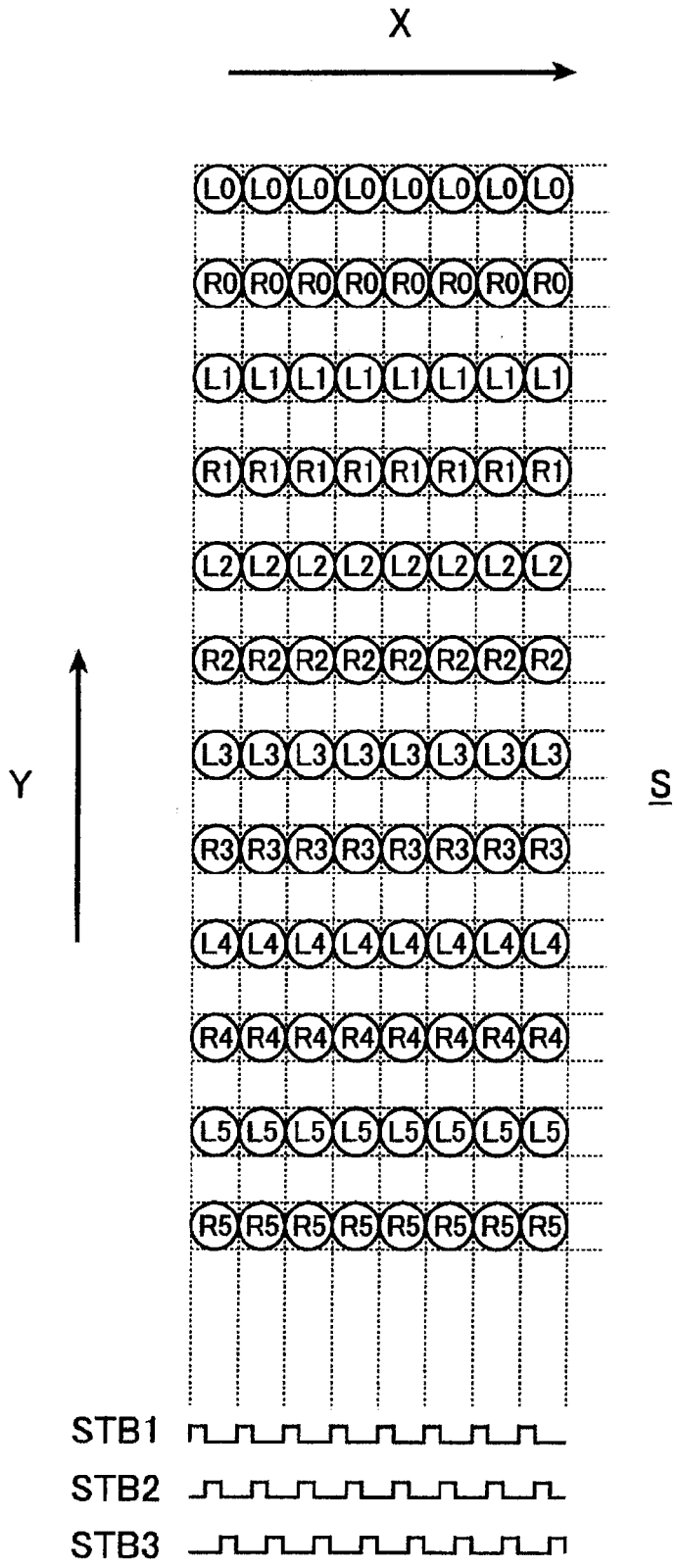
FIG. 16 PRIOR ART
FIG. 16 is a diagram showing pixel positions to which ink ejected via a conventional recording method lands and strobe pulses in a second embodiment.

Thus, provided that the recording head 5 is moved for scan in the main scanning direction X at a moving speed of L×f, and the nozzles NR3*m*, NR3*m*+1 and NR3*m*+2 and the nozzles NL3*m*, NL3*m*+1 and NL3*m*+2 of the recording head 5 of the present invention are respectively driven to eject with normal phase as FIG. 25 shows and with three-phase drive which has been carried out conventionally, as FIG. 16 shows, the ink ejected from each nozzle N of nozzle NR3*m* to NR3*m*+2 and nozzle NL3*m* to NL3*m*+2 through one scan of the recording head 5 in the main scanning direction X lands on every other pixel in the sub-scanning direction Y.

As FIG. 16 shows, in the present embodiment, in case ejection drive is conducted with three-phase drive which is conventionally carried out as above, the recording head 5 lands the ink through two scans (namely, two passes) on each pixel on the recording medium S so as to record the image on the recording medium S.

However, in the above case as well, if a nozzle N does not eject the ink normally due to a nozzle failure, since the portions to which the ink is not ejected line up serially in the main scanning direction X in the recorded image on the recording medium S, the streak pattern appears in the recorded image on the recording medium S and the image quality is deteriorated.

Therefore, in the present embodiment as well, by utilizing the recording method of the present invention, the control device 9 sets the moving speed in the main scanning direction of the carriage equipped with the recording head 5 at 2×L×f in the scan drive mechanism 10, and sets the head drive circuitry 51 so that ejection drive of the nozzle rows R3*m* to R3*m*+2 and the nozzle rows L3*m* to L3*m*+2 of the recording head 5 is carried out in a sequence from the nozzle row at the end to the nozzle row in front in a relative moving direction (main scanning direction X) of the recording head 5 with respect to the recording medium S (namely ejection drive is carried out with the reverse phase).

Figure 17:
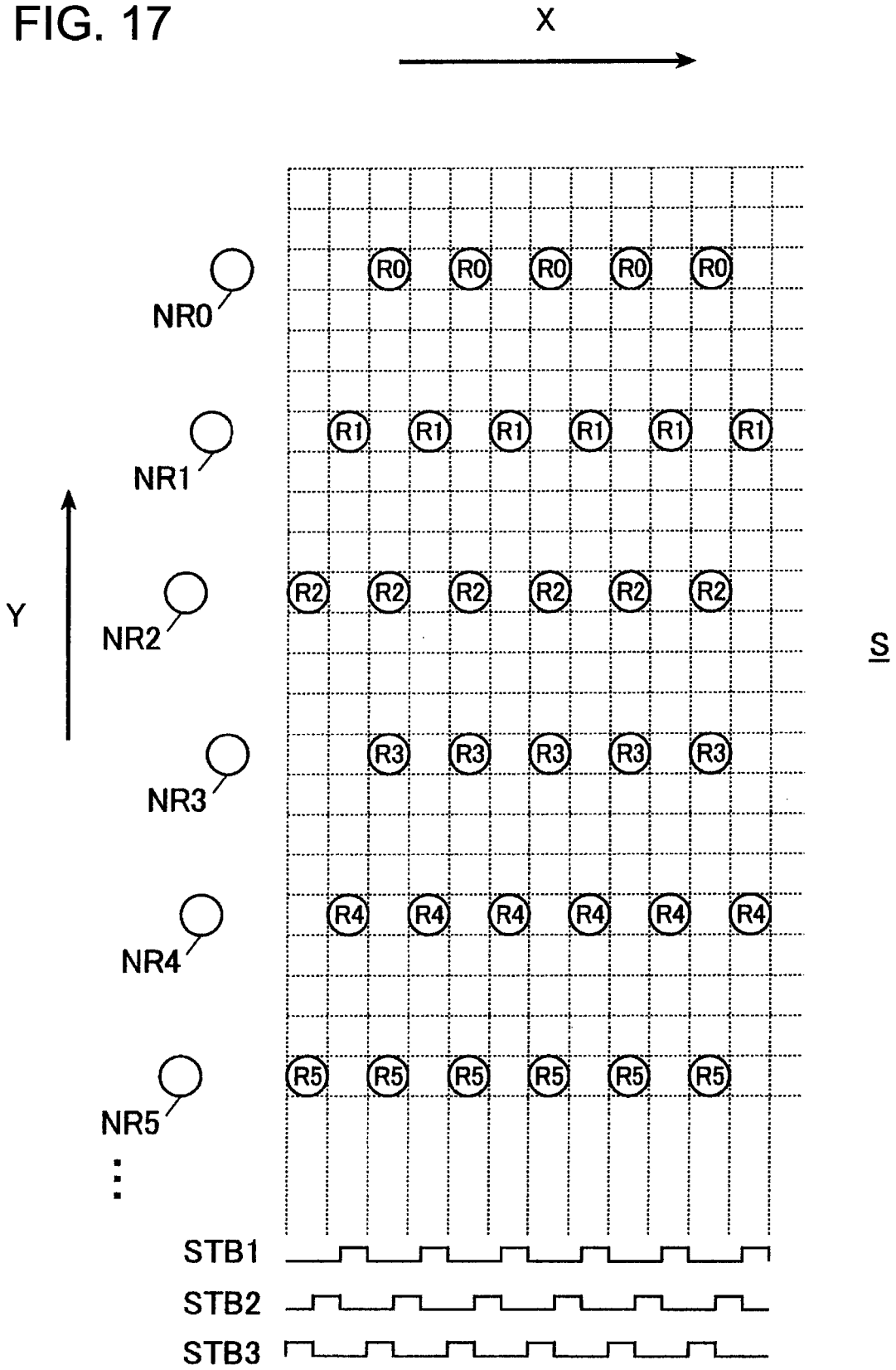
FIG. 17 is a diagram showing pixel positions to which ink lands, wherein the ink is ejected from a right side ink row of a recording head via a recording method of the present invention in a second embodiment.

By setting as above, in the recording operation, in accordance with the movement of the carriage 32 in the main scanning direction X along the carriage rail 31, the recording head 5 moves to scan in the main scanning direction X at the moving speed of 2×L×f, thus from each of nozzles NR3*m*, NR3*m*+1 and NR3*m*+2 of the nozzle rows R3*m*, R3*m*+1 and R3*m*+2 of the recording head 5, the ink is ejected to every other pixel in the main scanning direction X as FIG. 17 shows.

Figure 18:
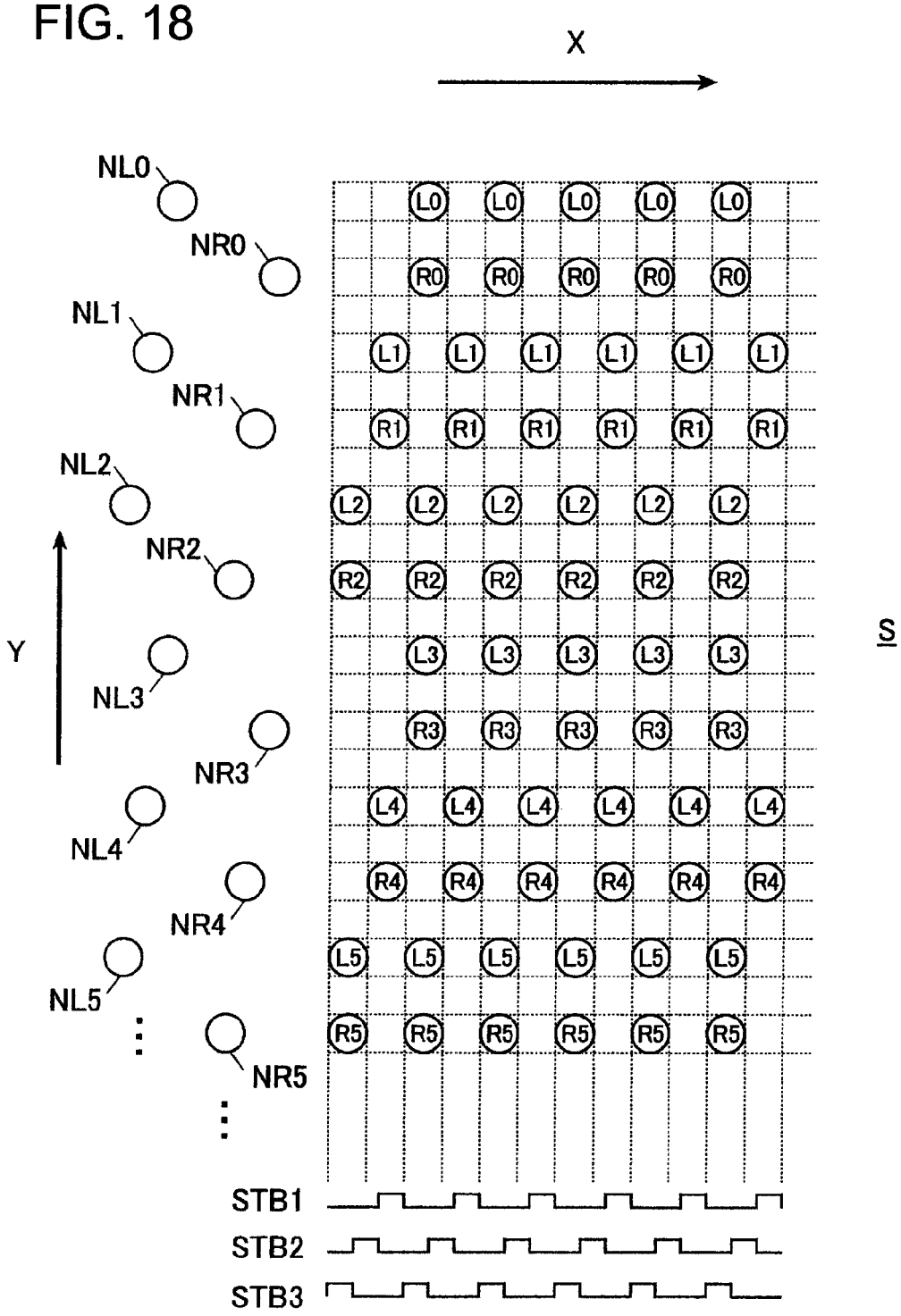
FIG. 18 is a diagram showing pixel positions to which ink lands in a second embodiment, wherein the ink is ejected from left and right ink rows of a recording head via a recording method of the present invention.
Figure 19:
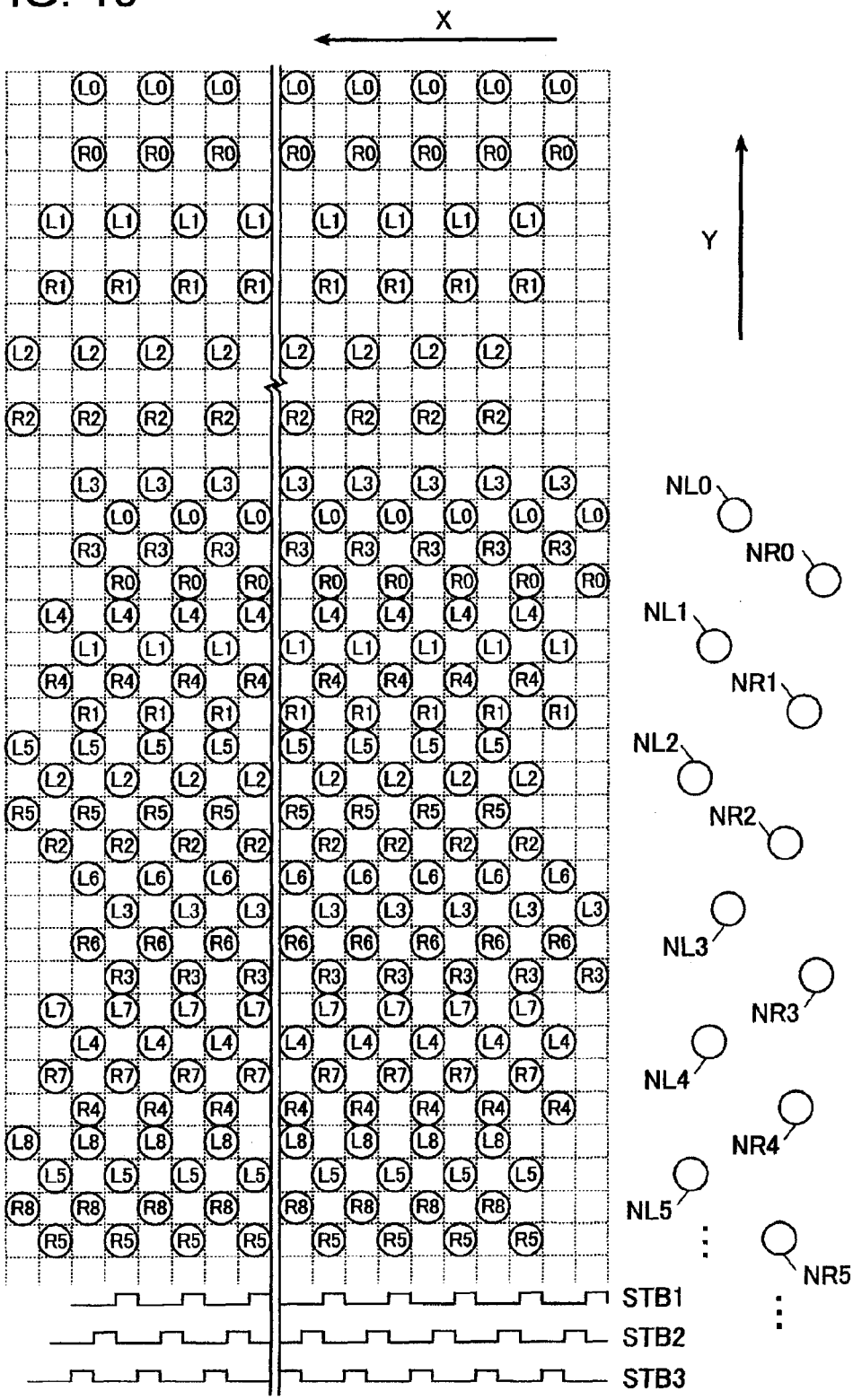
FIG. 19 is a diagram showing pixel positions in FIG. 18 and pixel positions to which ink lands via scan by a recording head in an opposite direction.

Incidentally, since 256 nozzles N are disposed respectively for the left and right sets, a total of 512 nozzles N as shown in FIG. 3, will make the drawing complicated, and so in FIGS. 18 to 19 including FIG. 17, descriptions are given assuming that 12 nozzles respectively for the left and right sets, a total of 24 nozzles (NL0 to NL11 and NR0 to NR11), record the image.

Also, as described in the foregoing, in the present embodiment, each of nozzles NR3*m*, NR3*m*+1 and NR3*m*+2 are set so that the interval between the adjacent nozzles N in the sub-scanning direction Y is four times the pixel pitch L, therefore the ink is ejected to every fourth pixel in the sub-scanning direction Y.

Also, in the same manner, while ink is ejected from the nozzles NL3*m*, NL3*m*+1 and NL3*m*+2 in the nozzle rows L3*m*, L3*m*+1 and L3*m*+2 of the recording head 5, since the nozzles NL3*m*, NL3*m*+1 and NL3*m*+2 are displaced by two pixel pitches with respect to the nozzles NR3*m*, NR3*m*+1 and NR3*m*+2 in the sub-scanning direction Y, as FIG. 18 shows, each of the nozzles NL3*m*, NL3*m*+1 and NL3*m*+2 eject the ink to every other pixel position which is adjacent to the pixel position to which the ink has been ejected from each of the nozzles NR3*m*, NR3*m*+1 and NR3*m*+2.

In the present embodiment as well, in one scan by the recording head 5 in the main scanning direction X, the control device 9 drives the drive motor 22 to move the recording medium S by a distance equal to a predetermined multiple of the pixel pitch in the conveyance direction Z (sub-scanning direction Y) and stops. In the subsequent scan by the recording head 5 in the main scanning direction X in the opposite direction, the ink is ejected from each nozzle to the pixel position other than the pixel position to which the ink has landed on the recording medium S by the preceding scans of the recording head 5.

For example, in case the ink is ejected to the pixel position on the recording medium S shown by FIG. 18 through one scan by the recording head 5 in the main scanning direction X, the control device 9 moves the recording S in the sub-scanning direction Y (for example, upward in the figure) by, for example, a distance equal to 13 times the pixel pitch, and stops, then in the subsequent scan by the recording head 5 in the main scanning direction X in the opposite direction, as FIG. 19 shows, each nozzle ejects ink to the pixel position which is located to the lower left in the figure with respect to the pixel position to which the ink has been landed on the recording medium S in the preceding scan by the recording head 5.

In the present embodiment, as FIG. 19 shows, since W2 is two times the pixel pitch, the number of the nozzles is 24 and number of multi-passes W3 to be described is four, the moving distance W1 is 12 times the pixel pitch which is calculated from the aforesaid formula: W1=number of nozzles×W2/W3.

However, in case W2 is two times the pixel pitch or more, since it is necessary to record the pixels between the nozzles N adjacent to each other in the sub-scanning direction Y, W1 has to be set by appropriately increasing or decreasing a calculated value of 12 times the pixel pitch.

In the present embodiment, as above in the second scan, in order to land the ink from each nozzle on the pixel position at the lower left in the figure with respect to the pixel position to which the ink has landed in the preceding scan on the recording medium S, W1 is made 13 times the pixel pitch.

However, different from the case in the first embodiment shown in FIG. 11, in the present embodiment, as FIG. 19 shows, the ink cannot land to all the pixels on the recording medium S through two scans by the recording head 5.

Thus, in the present invention, when two scans by the recording head 5 is completed, the control device 9 moves the recording medium S in the sub-scanning direction Y (for example, upward in the figure) by a distance of 11 times the pixel pitch again and stops to perform third scan by the recording head 5. In third scan by the recording head 5, each nozzle ejects the ink onto the pixel position which is on the right in the figure of the pixel position onto which the ink has landed in the first scan of the recording head 5 on the recording medium S.

When the third scan by the recording head 5 is completed, the control device 9 further moves the recording medium S in the sub-scanning direction Y (for example, upward in the figure) by a distance of 13 times the pixel pitch and stops to perform the fourth scan by the recording head 5. In the fourth scan by the recording head, each nozzle ejects the ink onto the pixel position below the pixel position in the figure onto which the ink has landed in the first scan of the recording head 5 on the recording medium S.

As above, in the present embodiment through four scans (namely four passes) by the recording head 5, the ink can be landed on each pixel on the recording medium S to record the image on the recording medium S.

When this occurs, as FIG. 19 shows, at least it is avoided that the ink ejected from the same nozzle N of the recording head 5 lands on the adjacent pixel position on the recording medium S. In same manner as in the first embodiment (refer to FIG. 12), even if there exist some nozzles N which cannot eject the ink normally due to nozzle failure, the ink ejected from other normal nozzle lands and fills the pixel position adjacent to the pixel position to which the ink, which has not been ejected form the defective nozzle N, is supposed to land.

Therefore, the portions, to which the ink has not been ejected, are prevented from lining up sequentially in the main scanning direction in the image recorded on the recording medium S and occurrence of the phenomenon that the streak pattern appears in the image can be avoided. Therefore, deterioration of the image quality can be suppressed.

As above, in the present embodiment as well, really the same effect as that of the first embodiment related to the inkjet recording apparatus 1 can be achieved.

Also, in case the conventional recording method shown in FIG. 16 is utilized, as described in the forgoing, the image can be recorded on the recording medium S through two scans (so-called two pass) by the recording head 5, though the recording method of the present invention shown in FIG. 18 requires four scans (so-called four passes) by the recording head 5 to record the image on the recording medium S.

However, since the moving speed of the recording head 5 in the main scanning direction X is two times the conventional moving speed, there is not much difference in the time required for image recording compared with that in the conventional recording method. Namely, in the present embodiment as well, the phenomenon that occurs in the conventional method that the streak pattern appears in the image can be avoided with almost the same recording time as that of the conventional method.

Third Embodiment

Incidentally, in the above first and second embodiments, as FIG. 12 shows, it is configured that one nozzle N ejects the ink to every other pixel in the main scanning direction X and the other nozzle N eject the ink so as to fill the intervals between the pixel positions. Namely, the ink is ejected from two nozzles N so as to line up alternately in the main scanning direction X.

By configuring as above, even if there exist some nozzles N which cannot eject ink normally due to nozzle failure, the phenomenon that the streak pattern, created by sequentially lining up the portions where the ink is not ejected in the main scanning direction X, appears in the recorded image on the recording medium S was avoided.

Expanding the above concept, by landing the ink ejected from one nozzle N with a further interval than every other pixel in the main scanning direction X on the recording medium S, and by filling the pixel position in the interval with the ink ejected from the other nozzle N, the pixel positions to which the ink is not ejected from the defective nozzles can be spread in the image, and thus appearance of the streak pattern in the recorded image on the recording medium S can be prevented more appropriately.

Therefore, in the ink jet recording apparatus related to the third embodiment, concerning each ejection cycle carried out within one scan by the recording head 5 in the main scanning direction X, the control device 9 provides an ejection cycle where the ink is ejected from each nozzle N and another ejection cycle where the ink is not ejected from each nozzle N in an ejection operation of each nozzle N.

In the following, a case where the recording head 5 (refer to FIG. 3) utilized in the inkjet recording apparatus 1 related to the first embodiment is used as the recording head 5 will be described. Meanwhile it can be applied to a case where the recording head 5 utilized in the second embodiment is used.

Specifically, in the present embodiment as well, the recording method of the present invention is employed in the same manner as that in the above first and the second embodiment. Namely, the control device 9 moves the recording head 5 at the moving speed of 2×L×f in the main scanning direction to scan, and also drives the nozzle rows R3*m* to R3*m*+2 and the nozzle rows L3*m* to L3*m*+2 of the recording head 5 to eject with the reverse phase.

Also, when one scan by the recording head 5 in the main scanning direction X is completed, the recording medium S is conveyed in the conveyance direction Z (sub-scanning direction Y) by a distance of a predetermined multiple of the pixel pitch, which is the same as in the first and second embodiment.

However, in the present embodiment, in the ejection operation of each nozzle N for each ejection cycle carried out within one scan by the recording head 5 in the main scanning direction X, the control device 9 is configured to set that the ejection cycle where the ink is ejected from each nozzle N and the ejection cycle when the ink is not ejected from each nozzle N are alternated.

Incidentally, whether or not the ejection cycle when ink is not ejected is provided can be set in accordance with the setting input of a user. Also, how the ejection cycles where the ink is ejected from each nozzle N and the ejection cycle where the ink is not ejected from each nozzle N are set can be set appropriately in advance or when the above setting input is conducted by the user.

Figure 20:
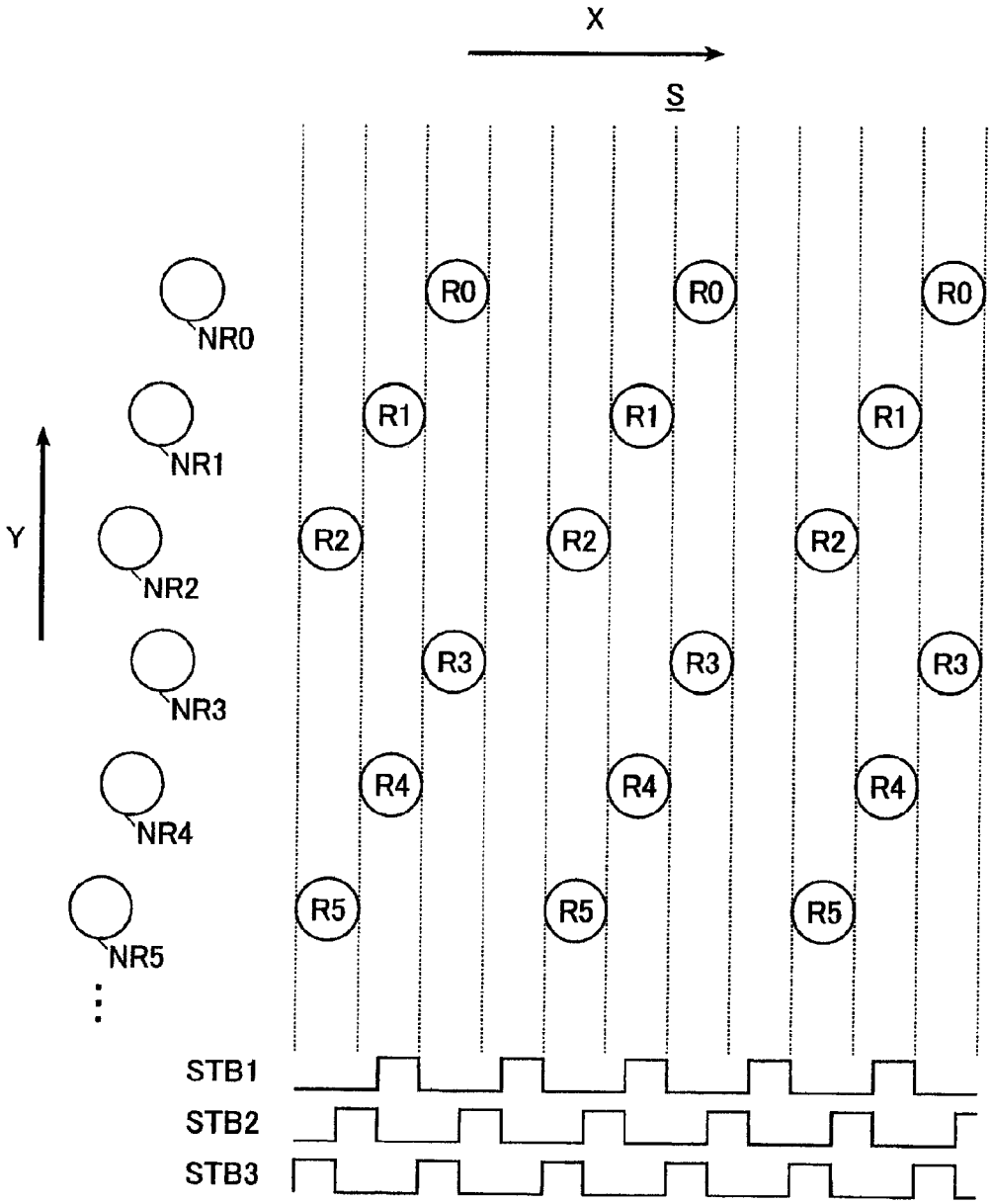
FIG. 20 is a diagram showing pixel positions to which ink lands, wherein the ink is ejected from a right side ink row of a recording head via recording method of the present invention in a third embodiment.

Under the above setting, as FIG. 20 shows, in the first ejection cycle, the ink is ejected from each of nozzles NR3*m*, NR3*m*+1 and NR3*m*+2 in the nozzle rows R3*m*, R3*m*+1 and R3*m*+2 of the recording head 5 to the pixel positions corresponding on the recording medium S, and the ink is not ejected in the subsequent ejection cycle.

Figure 21:
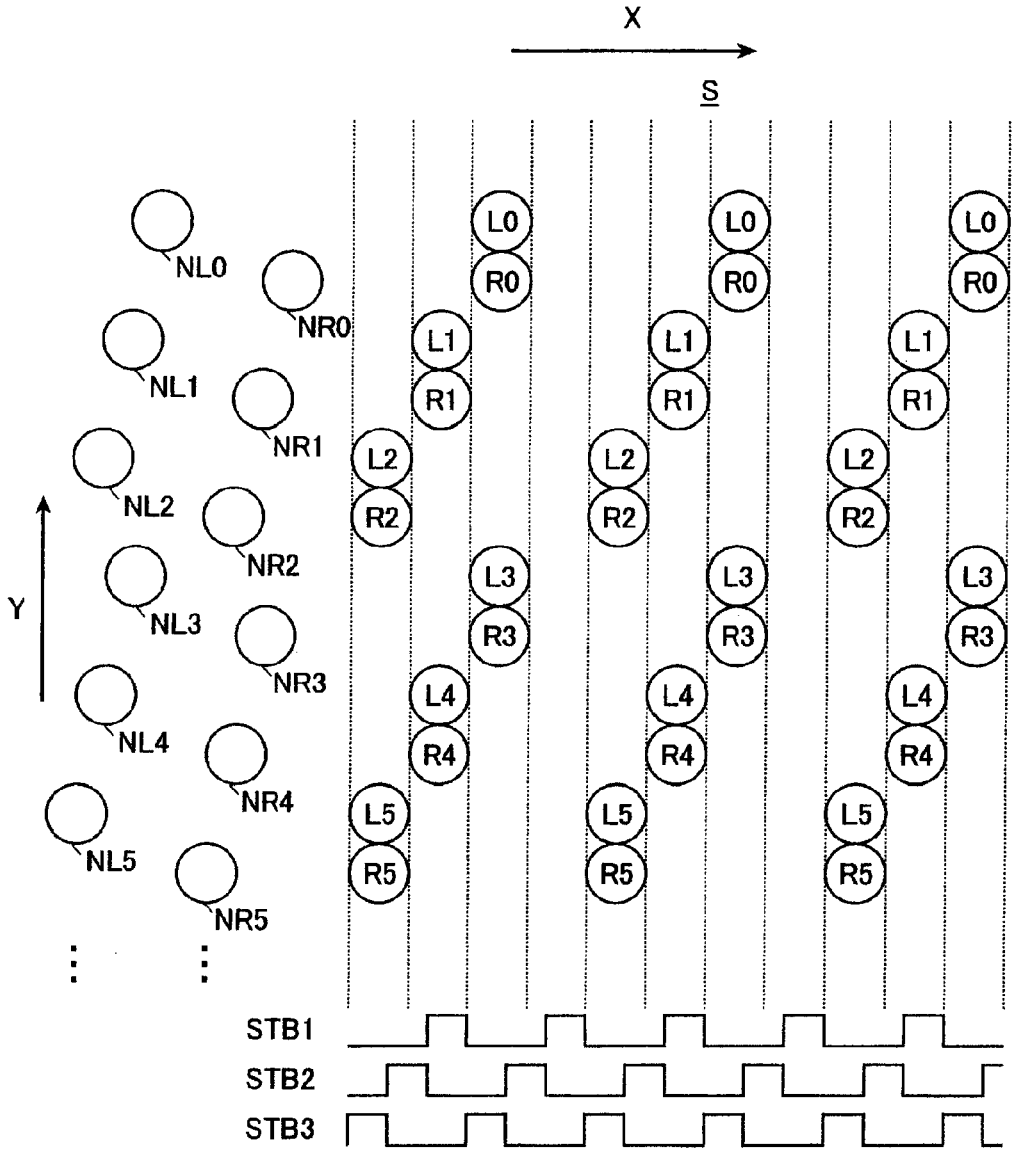
FIG. 21 is a diagram showing pixel positions to which ink lands, wherein the ink is ejected from left and right nozzle rows of a recording head via a recording method of the present invention in a third embodiment.
Figure 22:
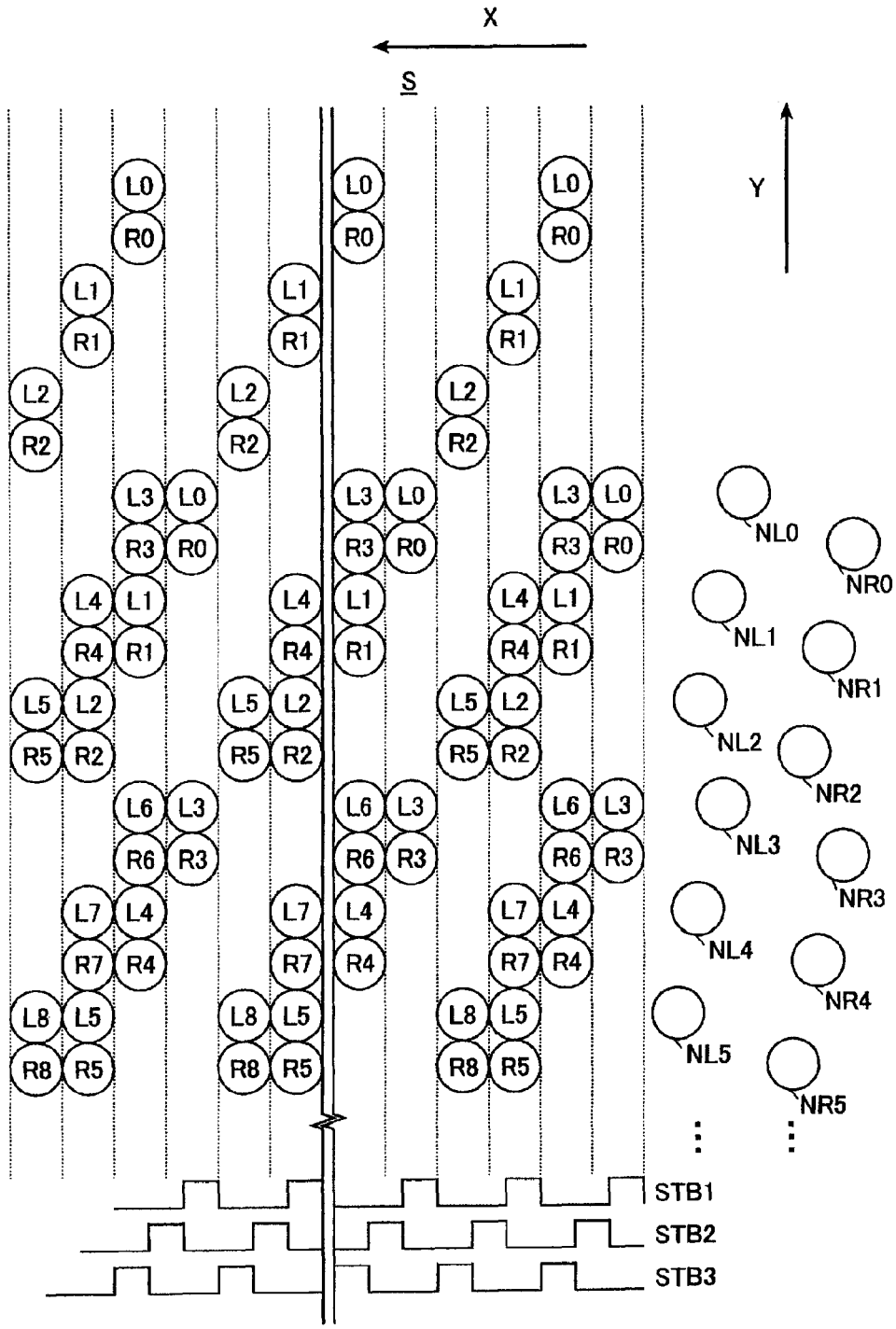
FIG. 22 is a diagram showing pixel positions in FIG. 21 and pixel positions to which ink lands through scan by a recording head in an opposite direction.
Figure 23:
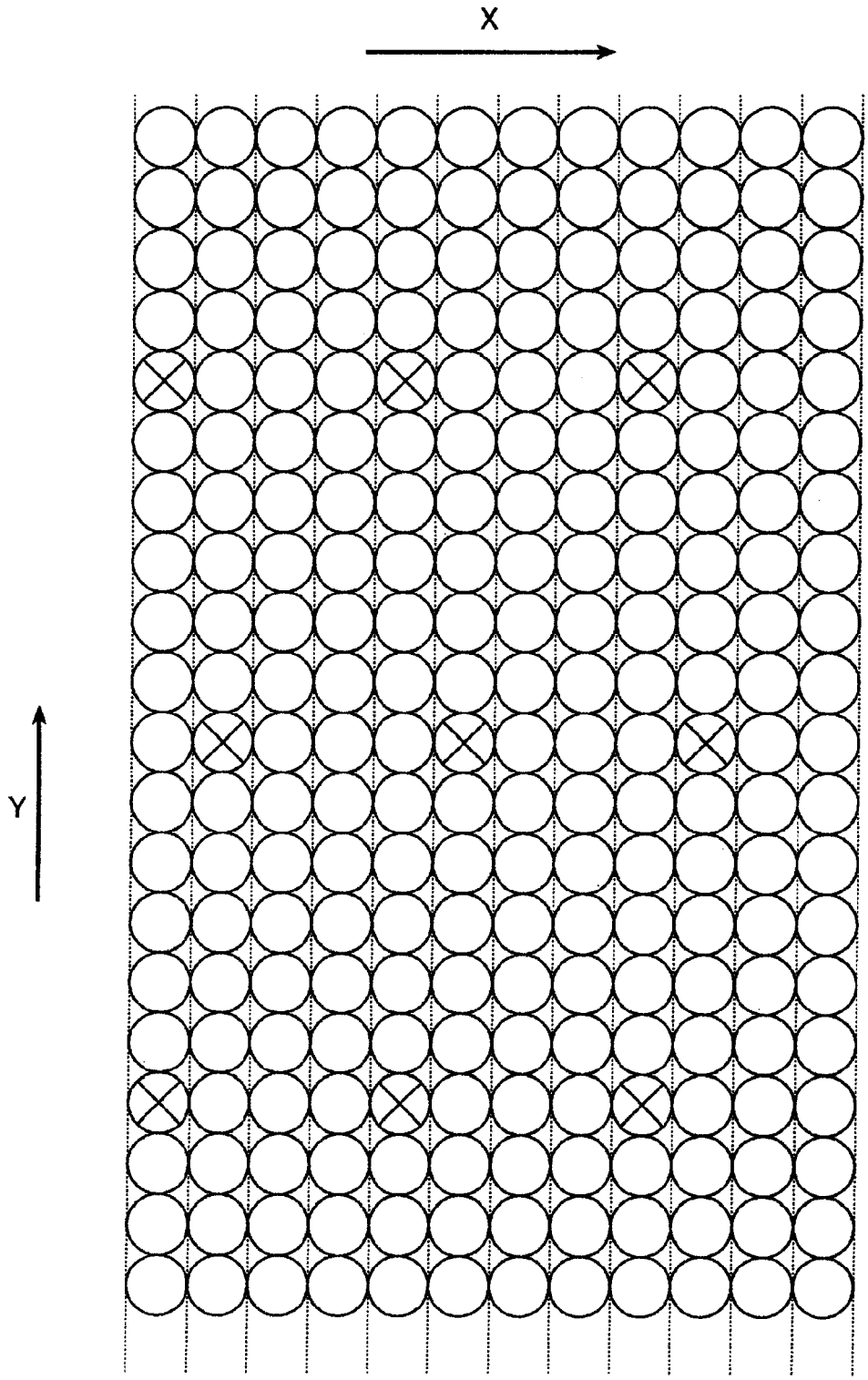
FIG. 23 is a diagram showing pixel positions in an image to which ink is not ejected from a nozzle in a third embodiment.

Incidentally, as FIG. 3 shows, if 256 nozzles are disposed respectively for left and right sets, a total of 512 nozzles are described, the figure becomes complicated, thus in FIGS. 21 to 23 including FIG. 20, description is given supposing that 12 nozzles respectively for left and right groups i.e. the total of 24 nozzles (NL0 to NL11 and NR0 to NR11) record the image.

By repeating the above ejection operation per the ejection cycle, the ink is ejected to every fourth pixel position corresponding to each of nozzles NR3*m*, NR3*m*+1 and NR3*m*+2 in the main scanning direction X on the recording medium S. Also, since the interval q between the adjacent nozzles NR3*m*, NR3*m*+1 and NR3*m*+2 NR3*m* in the sub-scanning direction Y is set to two times the pixel pitch L, the ink is ejected to every other pixel in the sub-scanning direction Y.

Also, each nozzle NL3*m*, NL3*m*+1 and NL3*m*+2 of the nozzle rows LM3*m*, L3*m*+1 and L3*m*+2 of the recording head 5 also eject the ink in the same manner however, the nozzles NL3*m*, NL3*m*+1 and NL3*m*+2 are displaced by one pixel pitch L with respect to the nozzles NR3*m*, NR3*m*+1 and NR3*m*+2. Thus as FIG. 21 shows, from each of nozzles NL3*m*, NL3*m*+1 and NL3*m*+2, the ink is ejected to the pixel position adjacent to the pixel position in the sub-scanning direction Y to which the ink has been ejected from each of nozzles NR3*m*, NR3*m*+1 and NR3*m*+2.

When one scan by the recording head in the main scanning direction X is completed, the control device 9 drives the drive motor 22 so as to convey the recording medium S in the conveyance direction Z (sub-scanning direction Y) by a distance of a predetermined multiple of the pixel pitch and stops, then moves the recording head 5 in the main scanning direction X in the opposite direction for scan.

For example, in case the ink is ejected to the pixel position on the recording medium S shown by FIG. 21 through one scan by the recording head 5 in the main scanning direction X, the control device 9 moves the recording medium S in the sub-scanning direction Y (for example, upward in the figure) by a distance of, for example, six times the pixel pitch and stops.

In the present embodiment, as FIG. 22 shows, since W2 is one time of the pixel pitch, the number of the nozzles is 24 and the number of the multi passes W3 is four, the moving distance W1 is six times the pixel pitch.

In the subsequent scan by the recording head 5 in the main scanning direction X in the opposite direction also, by alternating the ejection cycle in which the ink is not ejected from each nozzle and the ejection cycle in which the ink is ejected from each nozzle, as FIG. 22 shows, for example, the ink is ejected from each nozzle to the pixel position adjacent to the pixel position to which the ink has been landed through the preceding scan by the recording head 5 on the recording medium S.

As FIG. 22 reveals, in case of the present embodiment, image recording on the recording medium S cannot be completed through two scans (namely two passes). Thus, when the second scan by the recording head 5 in the main scanning direction X is completed, the control device 9 further moves the recording medium S by a distance of, for example, six times the pixel pitch in the sub-scanning direction Y (for example, upward in the figure) and stops.

Then the third scan by the recording head 5 in the main scanning direction X is conducted to eject ink to the adjacent pixel position from each nozzles N. When the third scan by the recording head 5 in the main scanning direction X is completed, in the same manner, the recording medium S is moved by a distance, for example, six times the pixel pitch in the sub-scanning direction Y (for example upward in the figure) and stops. Then the fourth scan by the recording head 5 in the main scanning is conducted to eject ink to the adjacent pixel position from each nozzles N.

As above, in case of the above configuration, through four scans (namely four passes) by the recording head 5, the ink is landed onto each pixel on the recording medium S and the image can be recorded on the recording medium S.

As above, in the present embodiment, completely the same effect as that of the inkjet recording apparatus 1 in the first embodiment and the second embodiment can be achieved.

Also, in the present embodiment, by landing the ink ejected from one nozzle N on the recording medium S with a larger interval than one pixel pitch in the main scanning direction X, the pixel positions in the interval portion can be filled with a plurality of ink droplets ejected from a plurality of other nozzles. For example, in case the ink is ejected as FIGS. 21 and 22 show, supposing that X denotes the pixel positions to which the ink supposed to be ejected from the defective nozzle N which cannot eject ink normally due to nozzle failure, as FIG. 23 shows, the pixel positions to which the ink is not ejected exist every three pixels.

As above, according to the present embodiment, even in case some nozzles N which cannot eject ink due to nozzle failure exist, the plurality of the pixel positions in the portion between the pixel positions to which the ink in not ejected from the defective nozzles N can be filled by landing of the plurality of the ink droplets ejected from the plurality of the normal nozzles N. Therefore, the pixel positions to which the ink is not ejected in the image are spread sparsely, and appearing of the streak pattern in the recorded image on the recording medium S can be appropriately prohibited.

1 Inkjet recording apparatus
3*m* to 3*m*+2 Nozzle rows
5 Recording head
9 Control device
f Ejection frequency
L Pixel pitch
N N3*m* to N3*m*+2, NR3*m* to NR3*m*+2, NL3*m* to NL3*m*+2 Nozzles
R3*m* to R3*m*+2, L3*m* to L3*m*+2 Two sets of nozzle rows
q Interval
S Recording medium
X Main scanning direction
(x, y) Pixel position
Y Sub-scanning direction

What is claimed is:

1. An inkjet recording apparatus comprising:

a recording head, driven by each drive phase of a three-phase current, having two sets of nozzle rows of three nozzle rows disposed in parallel in a main scanning direction and in which a plurality of nozzles are disposed in a staggered arrangement with an interval of L/3 in the main scanning direction, where L denotes a pixel pitch, wherein an interval between adjacent nozzles in a sub-scanning direction in a same nozzle row is set to be two times the pixel pitch, and the nozzles in one set of the nozzle rows are displaced by one pixel pitch in the sub-scanning direction with respect to the nozzles in another set of the nozzle rows; and a control device to drive each nozzle row of the recording head in a sequence from a nozzle row provided at an end to a nozzle row provided in front in a relative moving direction of the recording head with respect to a recording medium, and to move the recording head at a moving speed of 2×L×f in the main scanning direction, where f represents an ejection frequency for each nozzle row of the recording head, wherein when one scan by the recording head in the main scanning direction is completed, the control device moves the recording medium with respect to the recording head in the sub-scanning direction, which is perpendicular to the main scanning direction, by a distance of a predetermined multiple of the pixel pitch, and in a subsequent scan in the main scanning direction, the control device controls the recording head so that ink is ejected from each nozzle to a pixel position other than a pixel position where the ink has landed in the preceding scan by the recording head on the recording medium so as to record an image on the recording medium by landing the ink on each pixel on the recording medium.

2. The inkjet recording apparatus of claim 1, wherein in an ink ejection operation from each nozzle for each ejection cycle which is conducted within one scan by the recording head in the main scanning direction, the control section provides an ejection cycle where the ink is ejected from each nozzle and another ejection cycle where the ink is not ejected from each nozzle.

3. An inkjet recording apparatus comprising:

a recording head, driven by each drive phase of a three-phase current, having two sets of nozzle rows of three nozzle rows disposed in parallel in a main scanning direction and in which a plurality of nozzles are disposed in a staggered arrangement with an interval of L/3 in the main scanning direction, where L denotes a pixel pitch, wherein an interval between adjacent nozzles in a sub-scanning direction in a same nozzle row is set to be four times the pixel pitch, and the nozzles in one set of the nozzle rows are displaced by two pixel pitches in the sub-scanning direction with respect to the nozzles in another set of the nozzle rows; and a control device to drive each nozzle row of the recording head in a sequence from a nozzle row provided at an end to a nozzle row provided in front in a relative moving direction of the recording head with respect to a recording medium, and to move the recording head at a moving speed of 2×L×f in the main scanning direction, where f represents an ejection frequency for each nozzle row of the recording head, wherein when one scan by the recording head in the main scanning direction is completed, the control device moves the recording medium with respect to the recording head in the sub-scanning direction, which is perpendicular to the main scanning direction, by a distance of a predetermined multiple of the pixel pitch, and in a subsequent scan in the main scanning direction, the control device controls the recording head so that ink is ejected from each nozzle to a pixel position other than a pixel position where the ink has landed in the preceding scan by the recording head on the recording medium so as to record an image on the recording medium by landing the ink on each pixel on the recording medium.

4. The inkjet recording apparatus of claim 3, wherein in an ink ejection operation from each nozzle for each ejection cycle which is conducted within one scan by the recording head in the main scanning direction, the control section provides an ejection cycle where the ink is ejected from each nozzle and another ejection cycle where the ink is not ejected from each nozzle.

* * * * *